US010877396B2

(12) United States Patent
Sunahara et al.

(10) Patent No.: US 10,877,396 B2
(45) Date of Patent: Dec. 29, 2020

(54) IMAGE FORMING APPARATUS

(71) Applicant: CANON KABUSHIKI KAISHA, Tokyo (JP)

(72) Inventors: Satoshi Sunahara, Hachioji (JP); Nobuo Oshima, Inagi (JP); Satoru Motohashi, Kashiwa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/665,946

(22) Filed: Oct. 28, 2019

(65) Prior Publication Data

US 2020/0133167 A1 Apr. 30, 2020

(30) Foreign Application Priority Data

Oct. 31, 2018 (JP) ..... 2018-206161

(51) Int. Cl.
*G03G 15/08* (2006.01)
*G03G 15/00* (2006.01)
*G03G 21/20* (2006.01)

(52) U.S. Cl.
CPC ..... *G03G 15/0848* (2013.01); *G03G 15/55* (2013.01); *G03G 21/20* (2013.01); *G03G 2215/00772* (2013.01); *G03G 2215/00776* (2013.01)

(58) Field of Classification Search
CPC ..... G03G 15/0848; G03G 15/0863; G03G 15/0887; G03G 15/55; G03G 21/20; G03G 21/203; G03G 2215/00772; G03G 2215/00776
See application file for complete search history.

(56) References Cited

U.S. PATENT DOCUMENTS 8,090,279 B2 1/2012 Ishikuro
8,731,417 B2 5/2014 Shiori et al.
9,213,284 B2 * 12/2015 Okabayashi ..... G03G 15/2046
9,841,692 B2 12/2017 Hasegawa et al.
(Continued)

FOREIGN PATENT DOCUMENTS

JP 2007-237682 A 9/2007
JP 2012-198495 A 10/2012
(Continued)

*Primary Examiner* — Carla J Therrien
(74) *Attorney, Agent, or Firm* — Venable LLP

(57) ABSTRACT

An image forming apparatus includes a latent image forming portion configured to form a latent image on an image bearing member; a developing device including a container configured to store toner and a developing member configured to supply the toner to the latent image formed on the image bearing member to form a toner image; an environment sensor configured to detect environmental information related to an environment in which the developing device is placed; and a controller configured to control switching between a first mode and a second mode, in which a number of prints per unit time is less than that in the first mode. The controller is configured to perform switching from the first mode to the second mode based on an update value obtained by adding or subtracting over time an index value weighted in accordance with the environmental information detected by the environment sensor.

18 Claims, 8 Drawing Sheets

(56) References Cited

U.S. PATENT DOCUMENTS

| | | | | |
|---|---|---|---|---|
| 2007/0212083 | A1* | 9/2007 | Ishikuro | G03G 15/5008 399/44 |
| 2009/0080926 | A1* | 3/2009 | Kurokawa | G03G 15/2039 399/69 |
| 2011/0142460 | A1* | 6/2011 | Sugano | G03G 21/20 399/44 |
| 2013/0011150 | A1* | 1/2013 | Lee | G03G 15/6573 399/43 |
| 2014/0064756 | A1 | 3/2014 | Sugiyama et al. | |
| 2014/0168704 | A1* | 6/2014 | Hasegawa | G06K 15/1823 358/1.15 |
| 2020/0096924 | A1* | 3/2020 | Tanaka | G03G 15/0887 |

FOREIGN PATENT DOCUMENTS

| | | | |
|---|---|---|---|
| JP | 2014-052485 | A | 3/2014 |
| JP | 2017-107167 | A | 6/2017 |

* cited by examiner

IMAGE FORMING APPARATUS

BACKGROUND OF THE INVENTION

Field of the Invention

The present invention relates to an image forming apparatus, such as a copying machine, a printer, or a facsimile apparatus, which employs an electrophotographic system or an electrostatic recording system.

Description of the Related Art

In an image forming apparatus employing an electrophotographic system or other similar systems, a latent image formed on an image bearing member, for example, a photosensitive drum, is developed by a developing device with use of toner so that a toner image is formed. Then, the toner image is transferred onto a recording material, for example, a sheet of paper, directly or via an intermediate transfer member, and this recording material is heated and pressurized by a fixing device so that the toner image is fixed to the recording material.

In recent years, for the purpose of reducing power consumption in such an image forming apparatus, there has been developed toner that can be fixed at a temperature lower than that of toner in the related art (hereinafter also referred to as "low-temperature fixing toner"). For example, in Japanese Patent Application Laid-Open No. 2017-107167, an example of the low-temperature fixing toner is disclosed. When the fixing temperature can be decreased at the same printing speed, required power can be reduced accordingly, and hence great reduction in power consumption is enabled. The low-temperature fixing toner can be melted to be fixed to the recording material at a temperature lower than that of the toner in the related art. However, temperature rise in the image forming apparatus causes changes such as melting of a surface of the toner. Due to those changes, for example, a streak-like image defect (development stripe) caused by compaction of toner is liable to occur. In particular, when continuous drive (continuous printing, in which images are continuously formed on a plurality of recording materials) is performed, the temperature rise in the image forming apparatus becomes more conspicuous, and the toner stored in the developing device becomes more susceptible to temperature.

As a method of suppressing the temperature rise in the image forming apparatus, there is known a method in which, when the temperature in the image forming apparatus becomes equal to or higher than a threshold value, a mode is switched to a temperature rise suppression mode, in which an image forming operation is suspended or an operation speed is decreased (Japanese Patent Application Laid-Open No. 2012-198495, Japanese Patent Application Laid-Open No. 2007-237682, and Japanese Patent Application Laid-Open No. 2014-052485).

However, particularly when the low-temperature fixing toner is used, more attention to the temperature rise in the image forming apparatus is required as compared to the case in which general fixing toner is used, and there is assumed, for example, a situation in which the temperature rise suppression mode is executed at an earlier stage. In this case, however, there arises such a problem that the productivity of the image forming apparatus is reduced.

Therefore, an image forming apparatus capable of suppressing reduction in throughput while suppressing an image defect caused by temperature rise in the image forming apparatus is desired.

SUMMARY OF THE INVENTION

According to one of the embodiments, there is provided an image forming apparatus comprising: an image bearing member; a latent image forming portion configured to form a latent image on the image bearing member; a developing device including: a container configured to store toner; and a developing member configured to supply the toner to the latent image formed on the image bearing member to form a toner image; an environment sensor configured to detect environmental information related to an environment in which the developing device is placed; and a controller configured to control switching between a first mode, in which a number of prints per unit time is a first number, and a second mode, in which the number of prints per unit time is a second number, which is smaller than the first number, wherein the controller is configured to perform switching from the first mode to the second mode based on an update value obtained by performing over time one of addition and subtraction of an index value weighted in accordance with the environmental information detected by the environment sensor.

Further features of the present invention will become apparent from the following description of exemplary embodiments with reference to the attached drawings.

DESCRIPTION OF THE EMBODIMENTS

Figure 1:
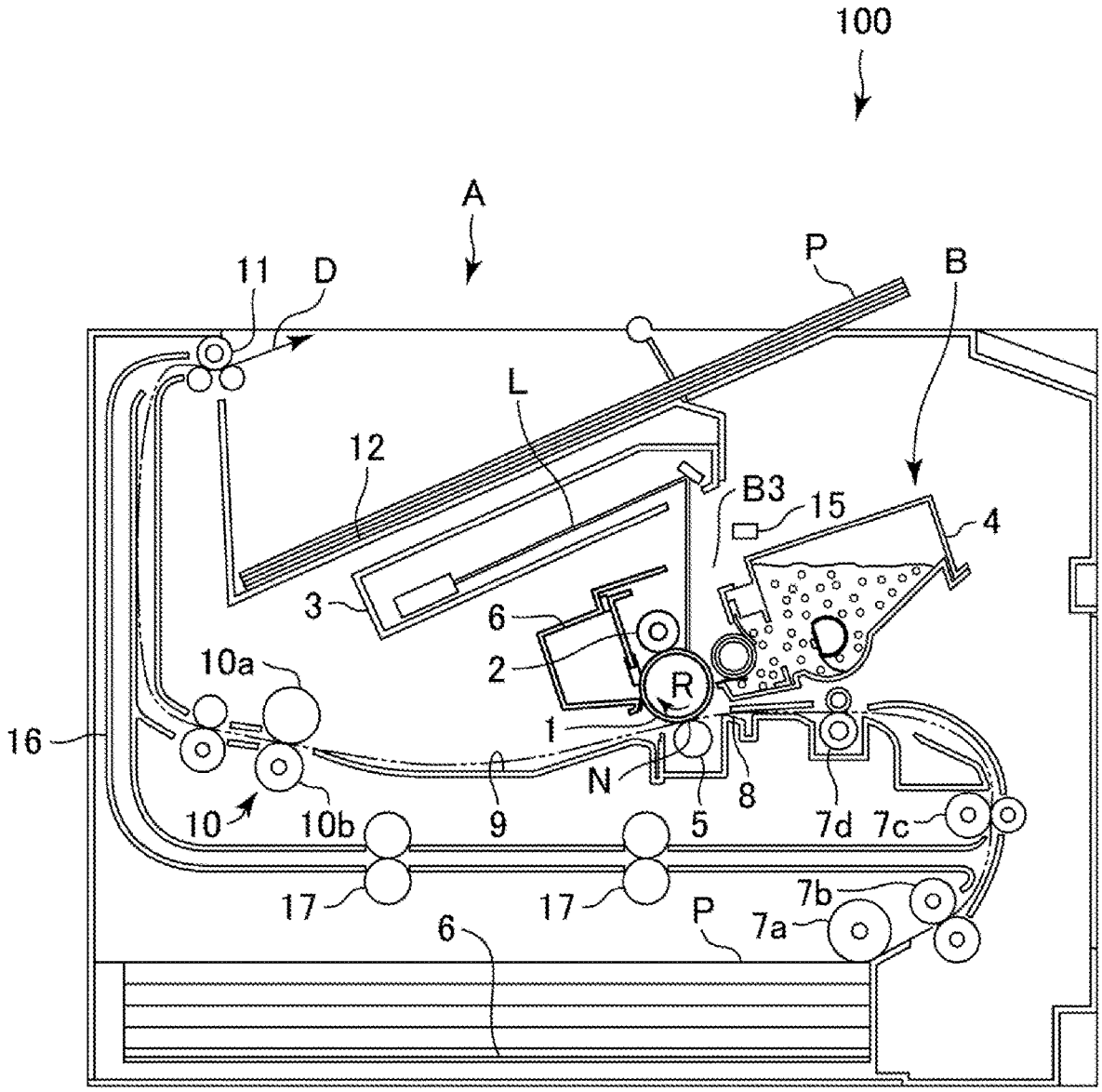
FIG. 1 is a schematic sectional view for illustrating an image forming apparatus.

The inventors have investigated to find that, when the temperature rise suppression mode in the related-art method is employed, for example, in a case in which low-temperature fixing toner is used, the following problem becomes more conspicuous.

The low-temperature fixing toner is susceptible to ambient temperature, and hence, in some cases, it may be required to decrease a threshold value of a temperature for performing switching from a normal mode to the temperature rise suppression mode. In those cases, the switching from the normal mode to the temperature rise suppression mode is performed earlier, and the switching from the normal mode to the temperature rise suppression mode is performed more frequently. As a result, the number of prints (throughput) per unit time is reduced, and the productivity of image formation is reduced.

In an actual case, the timing at which compaction of toner, which is a cause of the streak-like image defect (development stripe) described in the "Description of the Related Art" section, occurs depends on the circumstances before the occurrence of the compaction. For example, it is assumed that a case 1 corresponds to a case in which a slow printing speed (temperature is stable at 49° C.) is continued for a long time period, and then the mode is shifted to a mode in which the printing speed is fast (temperature is stable at 52° C.). Further, it is assumed that a case 2 corresponds to a case in which the image forming apparatus is operated in a mode in which the printing speed is fast (temperature is stable at 52° C.) from the beginning.

In the case, the case 1 and the case 2 differ in time elapsed until the same compaction state occurs. The time as a whole is shorter in the case 2. However, the time in which 52° C. is continued until the compaction state occurs is shorter in the case 1. That is, in the case 1, long-time continuation of the state of 49° C. exerts an influence. Further, when the state of 49° C. is continued for a long time period, the compaction state may occur even at 49° C.

As described above, the timing at which the compaction of toner occurs may be affected by the circumstances before the occurrence of the compaction. When a predetermined environment value (temperature) is set as a threshold value, the threshold value is required to be set to be relatively low with a margin. However, when a relatively low temperature is set, the frequency of the temperature rise suppression mode is increased. On the other hand, when the threshold value is set to be relatively high in order to decrease the frequency of the temperature rise suppression mode, the compaction occurs before the threshold value is reached, and a risk of causing an image defect is increased. For example, when the threshold value is set to 52° C., the compaction that occurs when 51° C. is continued cannot be detected. This problem is conspicuous particularly when the low-temperature fixing toner is used, but a similar problem occurs even when toner having a higher fixing temperature is used.

Therefore, in the following, description is given of an image forming apparatus capable of suppressing reduction in throughput while suppressing an image defect to be caused by temperature rise in the image forming apparatus.

In the following, an image forming apparatus according to one of the embodiments will be described in further detail with reference to the drawings.

First Embodiment

I. Overall Configuration and Operation of Image Forming Apparatus

Figure 2:
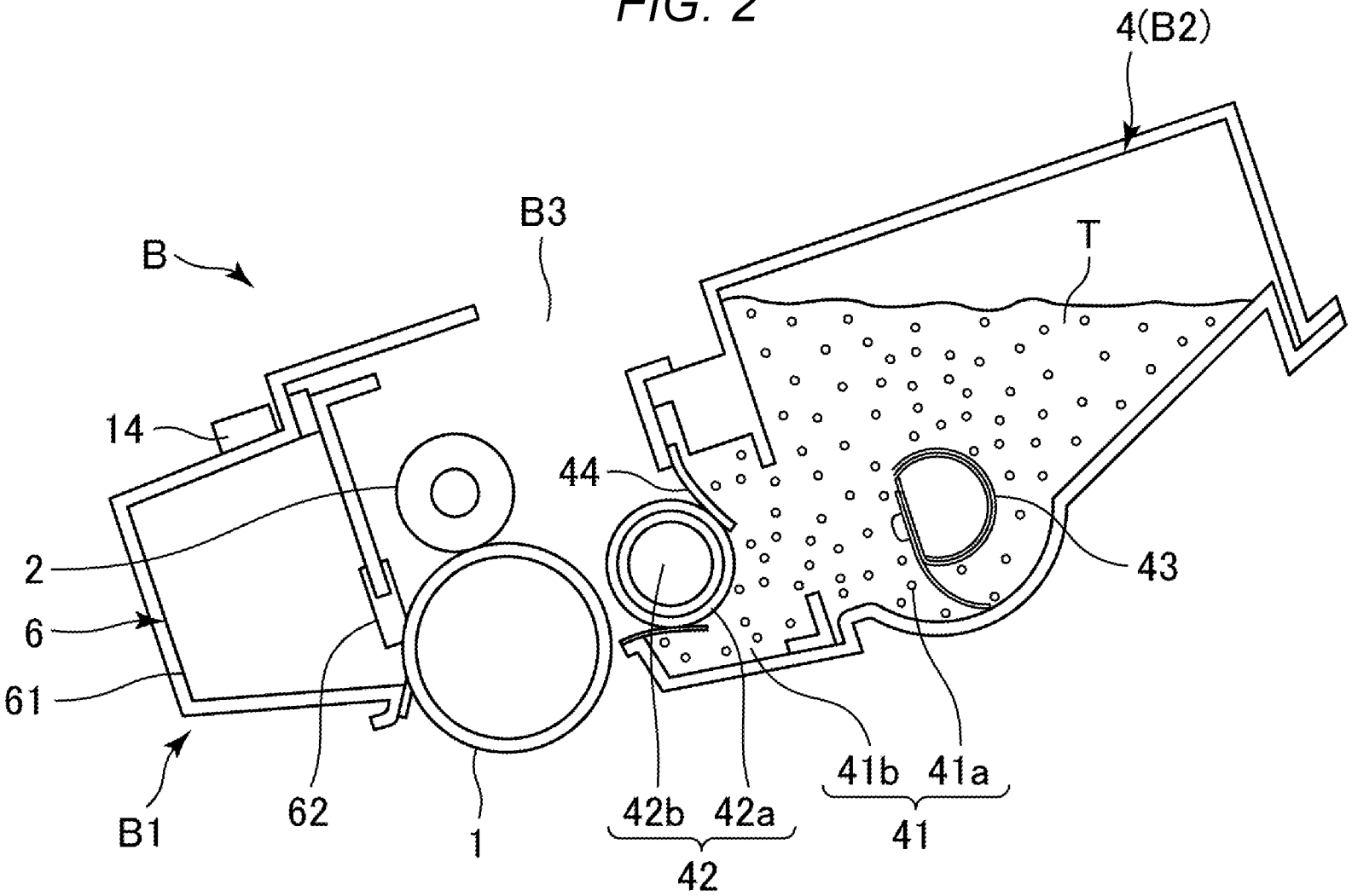
FIG. 2 is a schematic sectional view for illustrating a process cartridge.

FIG. 1 is a schematic sectional view for illustrating an image forming apparatus 100 according to a first embodiment. The image forming apparatus 100 according to the first embodiment is an electrophotographic laser beam printer of a type in which a process cartridge can be removably mounted. FIG. 2 is a schematic sectional view for illustrating a process cartridge B to be mounted to the image forming apparatus 100 according to the first embodiment.

In this case, the "electrophotographic image forming apparatus" refers to an apparatus configured to form an image on a recording medium (for example, recording paper or OHP sheet) with use of an electrophotographic image forming process. Examples of the electrophotographic image forming apparatus include an electrophotographic copying machine, an electrophotographic printer, a facsimile apparatus, and a multifunction peripheral having those functions. Further, the process cartridge refers to a member including a photosensitive member and at least one of a charging unit, a developing device, or a cleaning device serving as a process unit configured to act on the photosensitive member, which can be removably mounted integrally to an apparatus main body of the image forming apparatus.

As illustrated in FIG. 1, the image forming apparatus 100 according to the first embodiment includes a process cartridge (hereinafter simply referred to as "cartridge") B, which is removably mounted to an apparatus main body A of the image forming apparatus 100. As illustrated in FIG. 2, in the first embodiment, the cartridge B includes a cleaning unit B1 and a developing unit B2, which are integrally coupled to each other. The cleaning unit B1 includes a photosensitive drum 1, which is a drum-type (cylindrical) photosensitive member (electrophotographic photosensitive member) serving as an image bearing member, a charging roller 2, which is a roller-type charging member serving as a charging unit, and a cleaning device 6. The developing unit B2 includes a developing device 4.

Under a state in which the cartridge B is mounted to the apparatus main body A, an exposure device (laser scanner unit) 3 serving as an exposure unit (latent image forming portion) is arranged on the apparatus main body A on the upper side of the cartridge B. Further, under a state in which the cartridge B is mounted to the apparatus main body A, a tray 6 receiving recording materials (sheets or recording media) P, such as recording paper to be subjected to image formation, is arranged on the apparatus main body A on the lower side of the cartridge B. Further, in the apparatus main body A, along a direction D, in which the recording material P is to be conveyed, a pickup roller 7*a*, a feeding roller pair 7*b*, a conveyance roller pair 7*c*, a registration roller pair 7*d*, and a transfer guide 8 are sequentially arranged. Further, in the apparatus main body A, along the direction D in which the recording material P is conveyed, a transfer roller 5, which is a roller-type transfer member serving as a transfer unit, a conveyance guide 9, a fixing device 10, which is an image heating device serving as a fixing unit, a discharge roller pair 11, and a discharge tray 12 are sequentially arranged. The fixing device 10 includes a heating roller 10*a* and a pressure roller 10*b*.

The photosensitive drum 1 is driven by a drive force transmitted from a driving device 20 (FIG. 3) to rotate at a predetermined peripheral speed (process speed), which is 215 mm/sec in the first embodiment, in a direction of an arrow R of FIG. 1. A surface (outer peripheral surface) of the rotating photosensitive drum 1 is charged by the charging roller 2 to have a predetermined potential and a predetermined polarity (negative polarity in the first embodiment). The charging roller 2 is brought into contact with the surface of the photosensitive drum 1 to be rotated in association with the rotation of the photosensitive drum 1. When a charging step is carried out, a predetermined charging bias (charging voltage) is applied to the charging roller 2. The charged surface of the photosensitive drum 1 is scanned and exposed with light by the exposure device 3 in accordance with image information so that a latent image (electrostatic latent image or electrostatic image) corresponding to the image information is formed on the photosensitive drum 1. The exposure device 3 outputs laser light L corresponding to the image information. The laser light L passes through an exposure window portion B3 located at an upper surface of the cartridge B to scan and expose the surface of the photosensitive drum 1.

The latent image formed on the photosensitive drum 1 is developed (visualized) by toner being developer supplied by the developing device 4. Thus, a toner image (developer image) is formed on the photosensitive drum 1. The developing device 4 (developing unit B2) includes a container 41 configured to store toner T, and a developing roller 42 serving as a developing member configured to convey the toner T to a developing position (developing portion), which is a portion opposing the photosensitive drum 1. The developing device 4 further includes a conveying member 43 configured to stir and convey the toner T, and a developing blade 44 serving as a regulating member configured to regulate the toner T on the developing roller 42. The container 41 includes a toner chamber 41*a* and a toner supply chamber 41*b*. The conveying member 43 is arranged in the toner chamber 41*a*, and the developing roller 42 and the developing blade 44 are arranged in the toner supply chamber 41*b*. The developing roller 42 includes a hollow cylindrical developing sleeve 42*a*, and a magnet roller 42*b* arranged inside (in a hollow portion) of the developing sleeve 42*a* in a fixed manner. The developing sleeve 42*a* is driven by a drive force transmitted from the driving device 20 (FIG. 3) to rotate at a predetermined peripheral speed corresponding to the peripheral speed of the photosensitive drum 1. The toner T in the toner chamber 41*a* is stirred and conveyed by the rotation of the conveying member 43 to be supplied to the toner supply chamber 41*b*. The toner T is carried on the surface of the developing roller 42 (developing sleeve 42*a*) by a magnetic force of the magnet roller 42*b*. The toner T carried on the surface of the developing roller 42 is frictionally charged and regulated to have a predetermined layer thickness by the developing blade 44 arranged in abutment against the developing roller 42. The toner T on the surface of the developing roller 42 is moved onto the surface of the photosensitive drum 1 at the developing portion in accordance with the latent image formed on the photosensitive drum 1, and thus the toner image is formed. When a developing step is carried out, a predetermined developing bias (developing voltage) is applied to the developing roller 42.

Further, in synchronization with the timing at which the exposure device 3 outputs the laser light L, the pickup roller 7*a* feeds the recording material P from the tray 6, and the recording material P is conveyed by the feeding roller pair 7*b*, the conveyance roller pair 7*c*, and other rollers. Then, in synchronization with the timing at which the toner image on the photosensitive drum 1 arrives, the recording material P is supplied by the registration roller pair 7*d* to a transfer position (transfer portion) N, at which the photosensitive drum 1 and the transfer roller 5 are brought into contact with each other, via the transfer guide 8. The toner image formed on the photosensitive drum 1 is transferred at the transfer position N onto the recording material P nipped and conveyed by the photosensitive drum 1 and the transfer roller 5 through the action of the transfer roller 5. When a transfer step is carried out, a transfer bias (transfer voltage) having a polarity opposite to a normal charging polarity (charging polarity at the time of development) of toner is applied to the transfer roller 5.

The recording material P having the toner image transferred thereon is separated from the photosensitive drum 1 to be conveyed to the fixing device 10 along the conveyance guide 9. The recording material P passes through a fixing nip portion, at which the heating roller 10*a* and the pressure roller 10*b* are brought into contact with each other. The heating roller 10*a* and the pressure roller 10*b* are driven by a drive force transmitted from the driving device 20 (FIG. 3) to rotate at a predetermined peripheral speed corresponding to the peripheral speed of the photosensitive drum 1. The fixing device 10 pressurizes and heats the recording material P at this fixing nip portion so that the toner image is fixed to the recording material P.

In a case of simplex printing, in which an image is formed on only one surface of the recording material P, the recording material P having the toner image fixed on the one surface of the recording material P is discharged (output) by the discharge roller pair 11 to the discharge tray 12 provided outside of the apparatus main body A. Further, in a case of duplex printing, in which images are formed on both surfaces of the recording material P, before the whole recording material P having an image formed on the first surface is discharged to the outside of the apparatus main body A, the rotation of the discharge roller pair 11 is reversed at a predetermined timing. In this manner, the recording material P is introduced into a reverse path 16. The recording material P introduced into the reverse path 16 is conveyed toward the registration roller pair 7*d* again by refeeding roller pairs 17 and other rollers. The recording material P is, similarly to the case at the time of the image formation on the first surface, supplied to the transfer position N by the registration roller pair 7*d* so that a toner image is transferred onto a second surface on the opposite side of the first surface. The recording material P having the toner image transferred on the second surface has its toner image fixed to the second surface by the fixing device 10, and is then discharged to the discharge tray 12 by the discharge roller pair 11.

Further, toner (transfer residual toner) remaining on the surface of the photosensitive drum 1 after the transfer step is removed and collected from the surface of the photosensitive drum 1 by the cleaning device 6. The cleaning device 6 scrapes off the transfer residual toner from the surface of the photosensitive drum 1 by a cleaning blade 62 serving as a cleaning member arranged in abutment against the surface of the photosensitive drum 1 to store the toner into a collection toner chamber 61.

II. Control Mode

Figure 3:
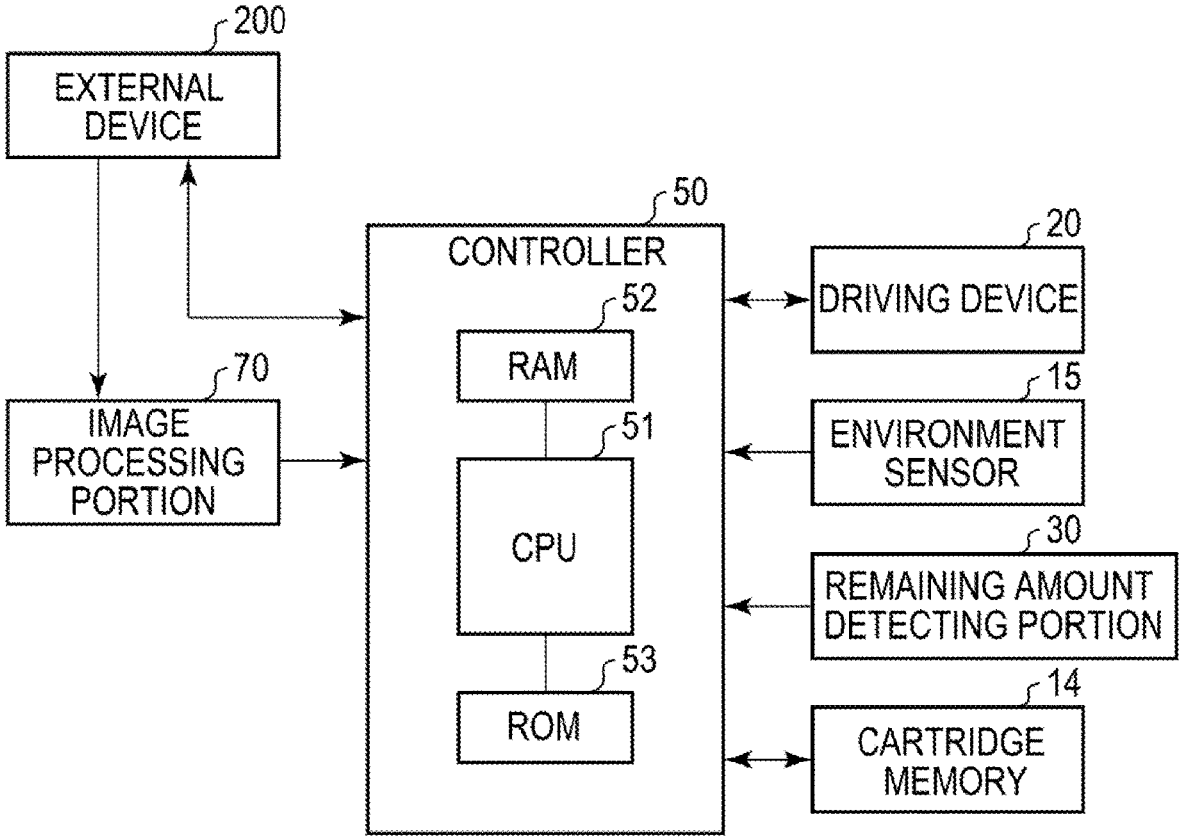
FIG. 3 is a schematic block diagram for illustrating a control mode of main portions of the image forming apparatus.

FIG. 3 is a schematic block diagram for illustrating a control mode of main portions of the image forming apparatus 100 according to the first embodiment. A controller 50 serving as a control unit includes a CPU 51 serving as an arithmetic control unit, which is a central element for performing arithmetic processing, and memories (storage media) such as a RAM 52 and a ROM 53 serving as a storage unit. The RAM 52 being a rewritable memory stores, for example, information input to the controller 50, detected information, and calculation results. The ROM 53 stores, for example, a control program, and a data table obtained in advance. The CPU 51 and the memories such as the RAM 52 and the ROM 53 can mutually transfer or read data. The controller 50 integrally controls the portions of the image forming apparatus 100 based on an image forming signal (image data or control command) output from an external device 200, for example, a personal computer, connected to the image forming apparatus 100, to thereby execute a printing operation (image forming operation). Further, the controller 50 is connected to, for example, an environment sensor 15, the driving device 20, a remaining amount detecting portion 30, an image processing portion 70, and a cartridge memory 14.

The environment sensor 15 is an example of an environment detection unit configured to detect environmental information related to an environment in which the developing device 4 is placed. In the first embodiment, the environment sensor 15 is formed of a temperature and humidity sensor configured to detect temperature and humidity. Further, in the first embodiment, the environment sensor 15 is arranged above the developing blade 44 as illustrated in FIG. 1 so that the temperature and the humidity in the vicinity of the developing roller 42, at which the temperature most rises in the developing device 4, can be measured. Further, in the first embodiment, while the image forming apparatus 100 is powered on, the environment sensor 15 always monitors the temperature and the humidity at intervals of one second, irrespective of the drive state of the image forming apparatus 100. The controller 50 can obtain a result (output signal) of detecting the temperature and the humidity by the environment sensor 15 as required. The environment detection unit is only required to detect environmental information related to at least one of temperature or humidity of at least one of inside or outside of the image forming apparatus 100 correlated to the environment in which the developing device 4 is placed. In the first embodiment, in particular, the environment detection unit is only required to be a temperature detection unit configured to detect temperature of the surrounding or the inside of the developing device 4. Further, a similar effect can be achieved even when the environment sensor 15 detects an amount of moisture in air instead of detecting humidity to output a signal corresponding to the amount of moisture.

As described above, the driving device 20 transmits a drive force to each of the photosensitive drum 1, the developing roller 42, the fixing device 10, and other members to drive those members to rotate. As described later, the controller 50 performs control of switching a mode between a first mode (normal mode), in which the number of prints per unit time is a first number, and a second mode (temperature rise suppression mode), in which the number of prints per unit time is a second number, which is smaller than the first number. When the controller 50 executes the printing operation in each of the above-mentioned modes, the controller 50 can drive the photosensitive drum 1, the developing roller 42, the fixing device 10, and other members at drive speeds set in advance so as to correspond to each of the modes.

The remaining amount detecting portion 30 is an example of a used amount detection unit configured to detect used amount information (hereinafter also referred to as "usage history information") related to a used amount (hereinafter also referred to as "usage history") from an initial state of the developing device 4 (from when the developing device 4 is brand new). In the first embodiment, the remaining amount detecting portion 30 detects the toner remaining amount information related to the toner remaining amount in the container 41 of the developing device 4. In this case, the toner remaining amount is represented as follows. The amount of toner initially stored in the container 41 of the developing device 4 is represented as 100%, and the amount of toner in the container 41 at the time when the toner is decreased to an amount set in advance as requiring replacement of the developing device 4 (cartridge B) is represented as 0%. As the remaining amount detecting portion 30, there are known units that are based on various principles. For example, there are known a unit of a capacitance detection type, which is based on detection of change in electrostatic capacitance in accordance with the amount of toner present between electrodes, and a unit of an optical detection type, which is based on detection of change in amount of light received by a light receiving portion in accordance with the amount of toner present in an optical path between a light emitting portion and the light receiving portion. As the remaining amount detecting portion 30, an available unit may be appropriately selected and used, but in the first embodiment, the unit of the capacitance detection type, which has an advantage in successively detecting the amount of toner in a relatively wide range, is used. In the first embodiment, the remaining amount detecting portion 30 includes an electrode pair (the developing roller 42 may be used as one of the electrodes) arranged in the container 41 of the developing device 4, and a circuit configured to convert a signal from the electrode pair into the toner remaining amount. The controller 50 can obtain the result of detecting the toner remaining amount by the remaining amount detecting portion 30 as required.

In the first embodiment, the image processing portion 70 is configured to perform processing of generating a signal for controlling the exposure device 3 based on image data transmitted from the external device 200, and to calculate a coverage rate of an image to be formed to input coverage rate information related to the coverage rate to the controller 50. The "coverage rate" refers to a rate of an area of an image with respect to that in a case in which an image is formed in all pixels of an image forming region. The coverage rate information is an example of toner consumption amount information related to a consumption amount of toner to be consumed from the developing device 4 per predetermined unit (for example, per unit time or per unit print number) in the printing operation.

The cartridge memory 14 is a memory (storage medium) provided in the cartridge B. When the cartridge B is mounted to the apparatus main body A, information can be read and written between the controller 50 and the cartridge memory 14 via a connection unit (not shown) provided on the apparatus main body A side. The cartridge memory 14 and the connection unit provided on the apparatus main body A side may be connected in contact with each other to enable communication therebetween, or may be connected in a non-contact manner to enable communication therebetween. In the first embodiment, the image forming apparatus 100 can mount a plurality of types of cartridges B (developing devices 4) that differ in amount of toner to be initially stored in the container 41. Further, in the first embodiment, the cartridge memory 14 stores identification information representing at least the type of the cartridge B (developing device 4), specifically, the amount of toner initially stored. The identification information representing the type of the cartridge B (developing device 4) is not limited to be stored in the memory. As long as the type of the cartridge B can be identified on the apparatus main body A side, any device that allows the information representing the type of the cartridge B to be attached, for example, electrically, magnetically, or physically (for example, as the shape of a member), can be used.

III. Development Stripe Occurrence Mechanism

Next, a mechanism of occurrence of a development stripe as an image defect to be caused by temperature rise is described.

When the toner reaches a predetermined temperature, an adhesive force between toner particles is increased because wax inside the toner seeps out, and thus the toner is liable to be compacted. After that, the compacted toner may be sandwiched between the developing blade 44 and the developing roller 42 to disturb toner coating on the developing roller 42. Therefore, a place with thick toner coating and a place with thin toner coating are generated on the developing roller 42. Then, when a halftone or solid image is printed, a streak-like image defect (development stripe) including a vertical streak (streak-like density unevenness extending in a direction in which the recording material P is conveyed, which corresponds to a direction in which the surface of the developing roller 42 is moved) may finally occur.

The easiness of toner compaction can be digitized as follows. For example, a powder tester of model PT-X, which is manufactured by Hosokawa Micron Corporation, is used, and sieves having openings of 75 μm, 38 μm, and 20 μm are placed in the stated order from the top in an overlapping manner. Further, Mg of toner is weighed and put into the sieve having the opening of 75 μm. Then, a predetermined vibration is applied under conditions of an amplitude of 1.5 mm and a vibration time period of 5 seconds. Then, when the amounts of toner remaining in the respective sieves are represented by X g, Y g, and Z g, a value obtained by an expression of $(X/M+3\times Y/5/M+Z/5/M)\times 100$ represents the cohesion degree of the toner.

IV. Estimation of State of Toner (Causes of Temperature and Time)

Figure 4:
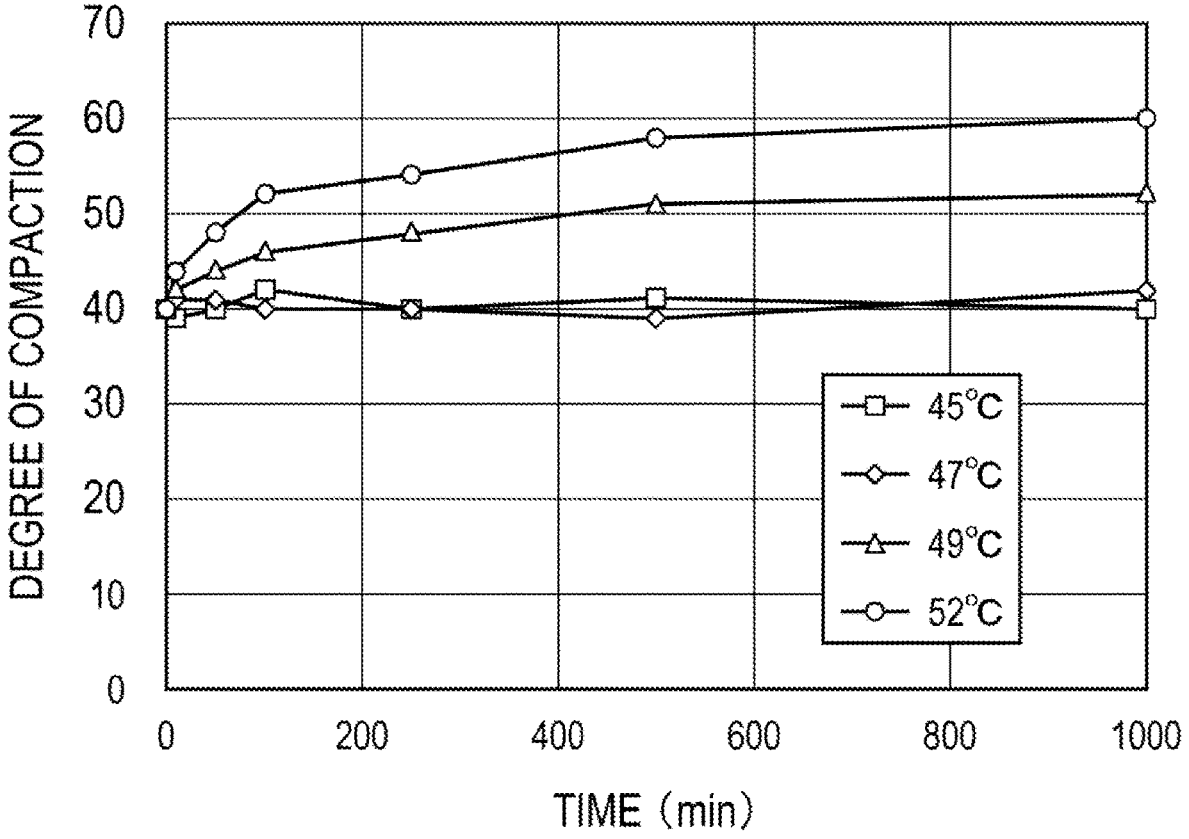
FIG. 4 is a graph for showing a relationship between an elapsed time and a cohesion degree of toner under a certain temperature.

First, as an investigation using a model, 100 g of toner was put into a container (plastic cup), and the toner was left for a predetermined time period under an atmosphere of a predetermined temperature and humidity. After that, the cohesion degree of the toner was measured so that an influence of temperature and humidity and of time on compaction of toner was observed. The results are shown in FIG. 4. In FIG. 4, the horizontal axis represents time, and the vertical axis represents cohesion degree of toner. The toner used in the first embodiment was hardly affected by humidity, and hence, in FIG. 4, there is shown a relationship between time and cohesion degree of toner when the toner is left for a certain time period under certain temperature environments (four conditions of 45° C., 47° C., 49° C., and 52° C.).

As is understood from FIG. 4, the cohesion degree of toner hardly changes at a temperature equal to or lower than 47° C., whereas the cohesion degree of toner increases along with elapse of time at a temperature equal to or higher than 49° C. Further, it is found that, when 49° C. and 52° C. are compared, the increase of the cohesion degree of toner is faster at 52° C.

Next, the toner left as described above was put into the developing device 4, and it was observed whether or not the development stripe was generated. The results are shown in Table 1. As evaluation criteria, a case in which the development stripe does not occur is represented by "o" (good), a case in which the development stripe does not occur although the toner coating on the developing roller 42 is slightly disturbed is represented by "A" (no problem in actual use), and a case in which the development stripe occurs is represented by "x" (failure).

TABLE 1

| | 45° C. | | 47° C. | | 49° C. | | 52° C. | |
|---|---|---|---|---|---|---|---|---|
| Time (min.) | Cohesion degree | Streak | Cohesion degree | Streak | Cohesion degree | Streak | Cohesion degree | Streak |
| 0 | 40 | ○ | 40 | ○ | 40 | ○ | 40 | ○ |
| 20 | 39 | ○ | 41 | ○ | 42 | ○ | 44 | ○ |
| 50 | 40 | ○ | 41 | ○ | 44 | ○ | 49 | ○ |
| 100 | 42 | ○ | 40 | ○ | 46 | ○ | 52 | Δ |
| 250 | 40 | ○ | 40 | ○ | 48 | ○ | 54 | Δ |
| 500 | 41 | ○ | 39 | ○ | 50 | ○ | 58 | x |
| 1,000 | 40 | ○ | 41 | ○ | 52 | Δ | 60 | x |

A relationship between the cohesion degree of toner and the occurrence of the development stripe, which is obtained based on the results shown in Table 1, is shown in Table 2.

TABLE 21

| Cohesion degree | Streak |
|---|---|
| 39 | ○ |
| 40 | ○ |
| 41 | ○ |
| 42 | ○ |
| 44 | ○ |
| 46 | ○ |
| 48 | ○ |
| 49 | ○ |
| 50 | ○ |
| 52 | Δ |
| 54 | Δ |
| 58 | × |
| 60 | × |

It is considered based on Table 2 that a threshold value of the cohesion degree of toner at which the disturbance of the toner coating on the developing roller 42 occurs is 50.

Further, it was observed how much time elapsed until the cohesion degree of toner reached 50 when the toner was left alone under a certain temperature environment.

The results are shown in Table 3.

TABLE 31

| Temperature (° C.) | Time (min.) |
|---|---|
| 48 | 840 |
| 49 | 420 |
| 50 | 240 |
| 51 | 120 |
| 52 | 60 |
| 53 | 30 |
| 54 | 12 |
| 55 | 6 |

Stated another way based on the results of Table 3, in both of a state in which toner is left for 420 minutes under a temperature environment of 49° C. and a state in which toner is left for 60 minutes under a temperature environment of 52° C., the cohesion degree of toner reaches 50, and hence it can be said that the state of toner is substantially the same. That is, it can be estimated that the influence of heat that the toner receives per minute under the temperature environment of 52° C. is seven times as large as the influence of heat that the toner receives per minute under the temperature environment of 49° C. In a similar way of thinking, the state of toner can be estimated by weighting the influence per unit time under each temperature.

The investigation described above used toner of a model left alone for a predetermined time period under a predetermined temperature. Duplex continuous printing, in which the temperature of the developing device 4 was liable to rise, was actually performed under an environment with the temperature of 32° C. and the humidity of 80% RH. A relationship among the number of prints, the cohesion degree of toner collected at the time of a suitable number of prints, and the disturbance of the toner coating on the developing roller 42 at that time was investigated. As a result, as shown in Table 1 and Table 2, it was found that the cohesion degree of 50 was substantially appropriate as the criterion of the cohesion degree of toner at which the disturbance of the toner coating on the developing roller 42 occurred.

As described above, as the condition for bringing the cohesion degree of toner to about 50, not only temperature but also time in which the toner is placed under the temperature environment greatly affects the occurrence of the compaction (Table 3). Therefore, it is found that, when temperature and time are considered, the state of toner can be estimated. Further, when the temperature changes over time, the circumstance until the compaction occurs, that is, how much time each temperature is continued, also affects the occurrence of the compaction. That is, it is found that the state of toner can be estimated by sequentially adding an index value that is weighted in consideration of temperature and time as information representing the state of toner.

V. Estimation of State of Toner (Causes other than Temperature and Time)

Next, causes other than temperature and time, which may affect the compaction of toner, are described.

First, the coverage rate may affect the compaction of toner. When the coverage rate is low, less toner is consumed, and hence less toner is exchanged on the developing roller 42. Therefore, the toner is liable to be compacted. When the coverage rate is high, new toner is coated on the developing roller 42 in place of consumed toner, and hence the compaction of toner is less liable to occur. That is, when the state of toner is estimated, it is preferred to perform weighting in a direction in which the compaction of toner proceeds faster in a case in which the coverage rate is low as compared to a case in which the coverage rate is high.

Figure 5A:
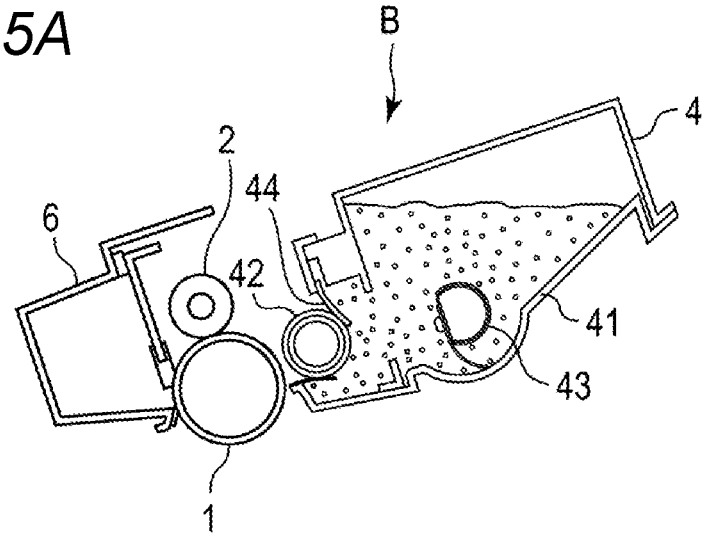
FIG. 5A, FIG. 5B, and FIG. 5C are schematic sectional views of a developing device, for illustrating states of toner depending on a cartridge usage history and a cartridge type.
Figure 5B:
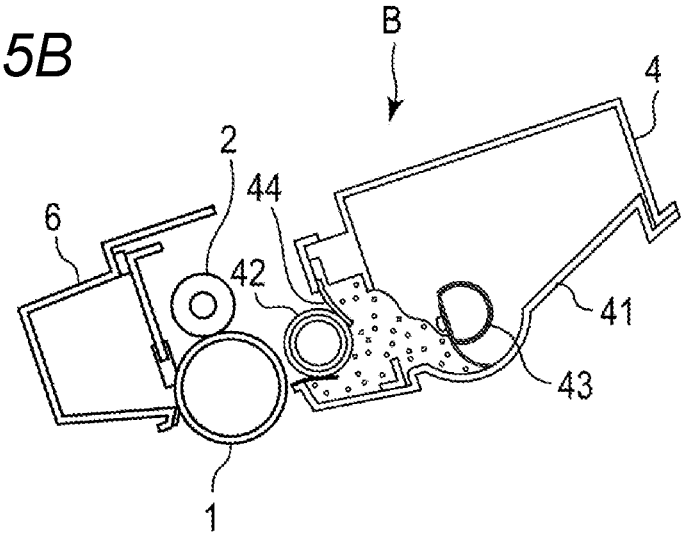

Further, the usage history of the cartridge B (developing device 4) may affect the compaction of toner. FIG. 5A and FIG. 5B are schematic sectional views for illustrating different usage history states of the cartridge B having a setting life of 10K (10,000) sheets (hereinafter also referred to as "10K cartridge"). FIG. 5A is an illustration of the 10K cartridge in an initial state (fully loaded state), and FIG. 5B is an illustration of the 10K cartridge at the time when the toner remaining amount is small. The toner remaining amount in the container 41 is gradually decreased by printing. Therefore, the toner remaining amount can be detected as an example of the usage history of the cartridge B so that the usage history of the cartridge B can be detected. In order to recognize how much toner in the cartridge B is consumed, that is, as the index of the usage history, as is known from the related art, the number of prints, the number of revolutions/drive time of the photosensitive drum 1, the number of revolutions/drive time of the developing roller 42, or other indexes may be adopted. Under a state in which the toner remaining amount is small as illustrated in FIG. 5B, the amount of toner is decreased, and hence, as compared to the fully loaded state illustrated in FIG. 5A, toner is repeatedly supplied to the vicinity of the developing roller 42 and thus is more liable to be compacted. In addition thereto, under this state, flowability of the toner itself may be reduced due to repeated stirring or other causes, or the toner may be affected by temperature as described above. As a result, toner is more liable to be compacted as compared to the fully loaded state illustrated in FIG. 5A. That is, when the state of toner is estimated, it is preferred to perform weighting in a direction in which the compaction of toner proceeds faster in a case in which the usage history of the cartridge B is long as compared to a case in which the usage history is short. The case in which the usage history of the cartridge B is long corresponds to a case in which the used amount from the initial state of the cartridge B is large, that is, a case in which the toner remaining amount is small. Further, the case in which the usage history of the cartridge B is short corresponds to a case in which the used amount from the initial state of the cartridge B is small, that is, a case in which the toner remaining amount is large.

Figure 5C:
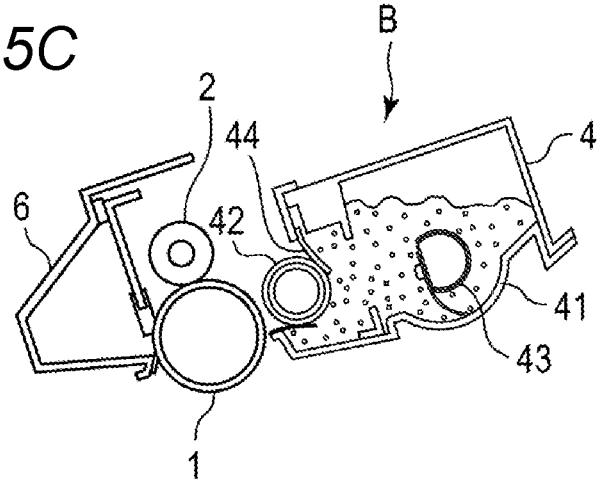

Further, the type of the cartridge B (developing device 4) (in more detail, the difference in container shape of the container 41 due to the difference in amount of toner to be initially stored in the container 41) may affect the compaction of toner. FIG. 5C is a schematic sectional view for illustrating an initial state (fully loaded state) of the cartridge B having a setting life of 5K (5,000) sheets (hereinafter also referred to as "5K cartridge"). The 10K cartridge and the 5K cartridge almost have no difference in amount of toner in the vicinity of the developing roller 42. However, when the circulation of toner in the container 41 is considered, the rate of toner in the vicinity of the developing roller 42 with respect to the toner in the container 41 is higher in the 5K cartridge than in the 10K cartridge, and hence it can be considered that the influence on the state of toner in the vicinity of the developing roller 42 appears faster in the 5K cartridge. That is, when the state of toner is estimated, it is preferred to perform weighting in a direction in which the compaction of toner proceeds faster in a case in which the setting life of the cartridge B is short (capacity of the container 41 is small) as compared to a case in which the setting life of the cartridge B is long (capacity of the container 41 is large).

As described above, when the state of toner is estimated, it is preferred to consider not only the above-mentioned environmental information but also the coverage rate information, the usage history information, and the identification information representing the type such as the size or volume of the cartridge B.

VI. Temperature Rise Suppression Mode

The image forming apparatus 100 according to the first embodiment can execute the printing operation while switching the mode between the following first mode (normal mode) and second mode (temperature rise suppression mode). The "first mode" (normal mode) refers to a mode in which the number of prints per unit time is a first number. The "second mode" (temperature rise suppression mode) refers to a mode in which the number of prints per unit time is a second number, which is smaller than the first number. In particular, in the first embodiment, as the temperature rise suppression mode to be performed during duplex printing, in which the temperature of the developing device 4 is liable to rise, a mode in which the process speed is dropped to half of that of the normal mode is provided. The "normal mode"

is also referred to as a "full speed mode", and the "temperature rise suppression mode" is also referred to as a "half speed mode".

A continuous printing test was performed in the following three printing operation settings under an environment of a temperature of 32° C. and a humidity of 80% RH.

TABLE 4

| Test No. | Simplex/Duplex | Full speed/Half speed | Number of print images |
|---|---|---|---|
| (1) | Duplex | Full speed | 2,000 |
| (2) | Duplex | Half speed | 1,000 |
| (3) | Simplex | Full speed | 5,000 |

Figure 6:
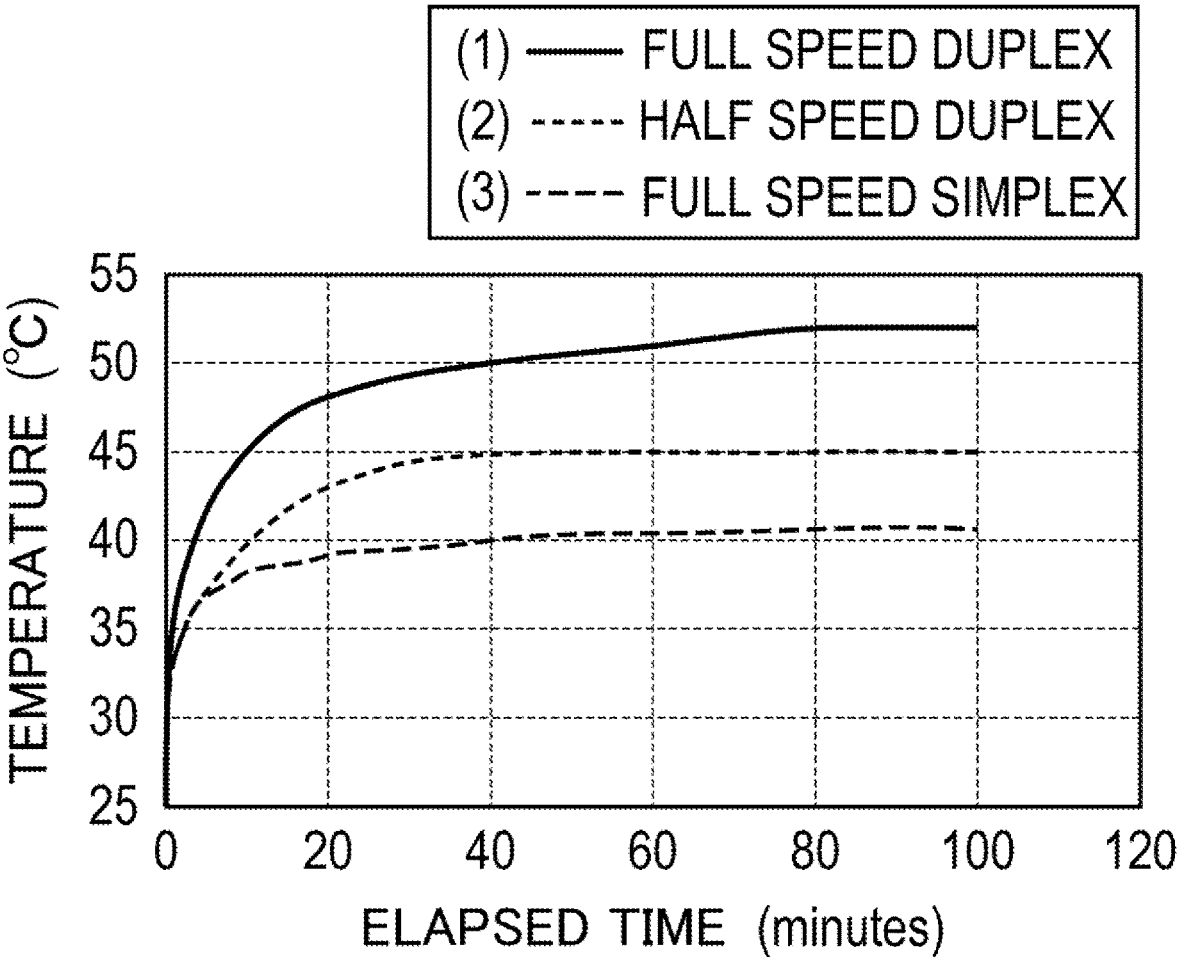
FIG. 6 is a graph for showing transition of temperature in the vicinity of the developing device under different printing operation settings.

This continuous printing test was performed without executing the temperature rise suppression mode to be described later. Further, in the continuous printing test, the temperature in the vicinity of the developing device 4 was measured. The results are shown in FIG. 6. In FIG. 6, the horizontal axis represents time, and the vertical axis represents temperature.

In a test (1), in which the duplex continuous printing was performed in the full speed mode, the temperature in the vicinity of the developing device 4 is saturated at 52° C. As shown in Table 3, at 52° C., the cohesion degree of toner reaches 50 after elapse of 60 minutes, and hence it is found that the development stripe may occur at a relatively early stage at high possibility.

In contrast, in a test (2), in which the duplex continuous printing was performed in the half speed mode, the temperature in the vicinity of the developing device 4 is saturated at 45° C. This temperature is a value that is sufficiently low to the extent that the cohesion degree of toner never reaches 50.

Further, in a test (3), in which the simplex continuous printing was performed in the full speed mode, the temperature in the vicinity of the developing device 4 is saturated at 41° C. This temperature has the lowest value among the tests (1) to (3).

The temperature in the vicinity of the developing device 4 is the lowest in the test (3) due to the following reason. That is, in the tests (1) and (2), in which the duplex continuous printing was performed, the recording material P that has passed through the fixing device 10 to be heated once while the first surface is printed passes through the fixing device 10 when the second surface is printed. As a result, an effect of increasing the temperature in the vicinity of the developing device 4 is caused more in the tests (1) and (2) than in the test (3).

Further, the full speed mode and the half speed mode differ in temperature in the vicinity of the developing device 4 due to the following reason. That is, in the half speed mode, the process speed is halved, that is, the time in which the recording material P passes through the fixing device 10 is doubled. As a result, the amount of heat that the fixing device 10 is required to apply per unit time to the recording material P having the toner image formed thereon may be smaller than that in the case of the full speed mode. In the fixing device 10, a heater temperature is adjusted so that the temperature to be detected by the temperature detection unit becomes substantially constant.

In this case, although the test results are not shown, when the simplex continuous printing is performed in the half speed mode, the temperature in the vicinity of the developing device 4 is saturated at a temperature that is lower than that in the case in which the simplex continuous printing is performed in the full speed mode due to the reason similar to the above.

Based on the investigation described above, in the first embodiment, when a predetermined condition (to be described later) is satisfied during duplex printing, the mode is switched from the full speed mode as the normal mode to the half speed mode as the temperature rise suppression mode. In the first embodiment, as is understood from the above-mentioned investigation, the cohesion degree of toner never reaches 50 even when the simplex printing is continuously performed in the full speed mode. Therefore, in the first embodiment, the simplex printing is always performed in the full speed mode, and the temperature rise suppression mode is not provided. However, the simplex printing may be able to be performed in the temperature rise suppression mode, for example, the half speed mode, depending on the configuration (characteristic of the toner) of the image forming apparatus 100 or other factors. In this case, when a predetermined condition is satisfied during the simplex printing, the mode may be switched from the full speed mode as the normal mode to the half speed mode as the temperature rise suppression mode.

As described above, in the first embodiment, as the temperature rise suppression mode, the mode is switched from the full speed mode to the half speed mode without suspending the printing operation. The reason is as follows. First, reduction in throughput can be suppressed because printing is performed even in the half speed mode. Further, the printing operation is performed at a temperature that is high to some extent until the temperature is decreased, but the toner coated on the developing roller 42 at this time point is consumed by printing or exchanged. Therefore, the toner is not immediately compacted.

VII. Activation of Temperature Rise Suppression Mode

In the first embodiment, the controller 50 performs switching from the first mode (normal mode) to the second mode (temperature rise suppression mode) based on an update value (cumulative value) obtained by adding over time an index value that is weighted in accordance with the environmental information detected by the environment sensor 15. In the first embodiment, the controller 50 performs switching from the first mode to the second mode when the above-mentioned update value reaches a predetermined threshold value. At this time, the controller 50 weights the above-mentioned index value so that, as compared to a case in which the temperature represented by the environmental information is a first temperature, a case in which the temperature represented by the environmental information is a second temperature, which is higher than the first temperature, takes a larger value.

Further, in the first embodiment, the controller 50 performs switching from the normal mode to the temperature rise suppression mode based on the above-mentioned update value obtained by adding over time the above-mentioned index value that is weighted in accordance with at least one piece of other information in addition to the environmental information. In the first embodiment, the above-mentioned at least one piece of other information includes toner consumption amount information related to a consumption amount of toner to be consumed from the developing device 4 per predetermined unit in the image forming operation. The controller 50 weights the above-mentioned index value so that, as compared to a case in which the consumption amount of toner represented by the toner consumption amount information with respect to a predetermined unit (for example, one page) is a first consumption amount, a case in which the consumption amount of toner represented by the toner consumption amount information is a second consumption amount, which is smaller than the first consumption amount, takes a larger value. In particular, in the first embodiment, the toner consumption amount information is coverage rate information related to a coverage rate of an image to be formed. The toner consumption amount information is not limited to the coverage rate information, and the toner consumption amount information is only required to be information correlated to the consumption amount of toner to be consumed from the developing device 4 per predetermined unit (for example, predetermined time period or one page) in the image forming operation. For example, the toner consumption amount information may be the consumption amount itself per predetermined unit, which is calculated based on image data or other items.

Further, in the first embodiment, the image forming apparatus 100 can mount a plurality of types of developing devices 4 that differ in amount of toner to be initially stored in the container 41, and the above-mentioned at least one piece of other information includes identification information representing the type of the developing device 4. The controller 50 weights the above-mentioned index value so that, as compared to a case in which the amount of toner in the initial state of the developing device 4 mounted to the image forming apparatus 100, which is represented by the identification information, is a first amount, a case in which the amount of toner in the initial state of the developing device 4 mounted to the image forming apparatus 100, which is represented by the identification information, is a second amount, which is smaller than the first amount, takes a larger value.

Further, in the first embodiment, the above-mentioned at least one piece of other information includes used amount information related to the used amount from the initial state of the developing device 4. The controller 50 weights the above-mentioned index value so that, as compared to a case in which the used amount represented by the used amount information is a first used amount, a case in which the used amount represented by the used amount information is a second used amount, which is larger than the first used amount, takes a larger value. In particular, in the first embodiment, the used amount information is toner remaining amount information related to the amount of toner remaining in the container 41. The used amount information is not limited to the toner remaining amount information. As long as the used amount information is information correlated to the used amount of the developing device 4, the used amount information may be, for example, information on the consumption amount of toner from the developing device 4, or information on the rotation time or the number of revolutions of the developing roller 42, the photosensitive drum 1, or other rotary members. Detailed description is given below.

In the first embodiment, in consideration of the above-mentioned elements that affect the compaction of toner, a table having a point (index value) to be added to estimate the state of toner was set as follows.

As the cartridge B, two types of the 10K cartridge (FIG. 5A and FIG. 5B) and the 5K cartridge (FIG. 5C) were set. Further, as the coverage rate, three levels of lower than 1.5%, 1.5% or more and lower than 3%, and 3% or more were set. Further, as the toner remaining amount, three levels of the remaining amounts of from 100% to 61%, from 60% to 31%, and from 30% to 0% were set for the case of the 10K cartridge, and two levels of the remaining amounts of from 100% to 61% and from 60% to 0% were set for the case of the 5K cartridge. Then, there was set a table representing the point to be added in accordance with the degree (° C.) of the temperature detected at intervals of one second, under the conditions of the type of the cartridge B, the coverage rate, and the toner remaining amount. The table having the above-mentioned point for the 10K cartridge is shown in Table 5, and the table having the above-mentioned point for the 5K cartridge is shown in Table 6. Further, in Table 5 and Table 6, there is also shown a threshold value to be compared with the update value of the above-mentioned point in order to determine the timing to perform switching from the normal mode to the temperature rise suppression mode.

TABLE 5

| | 10K cartridge | | | | | | | | |
|---|---|---|---|---|---|---|---|---|---|
| | Toner: 100% to 61% | | | Toner: 60% to 31% | | | Toner: 30% to 0% | | |
| | Coverage rate: lower than 1.5% | Coverage rate: 1.5% or more and lower than 3% | Coverage rate: 3% or more | Coverage rate: lower than 1.5% | Coverage rate: 1.5% or more and lower than 3% | Coverage rate: 3% or more | Coverage rate: lower than 1.5% | Coverage rate: 1.5% or more and lower than 3% | Coverage rate: 3% or more |
| 47.4° C. or lower | 0 | 0 | 0 | 0 | 0 | 0 | 0 | 0 | 0 |
| 47.5° C. to 48.4° C. | 2 | 2 | 2 | 3 | 3 | 3 | 4 | 4 | 4 |
| 48.5° C. to 49.4° C. | 4 | 4 | 4 | 6 | 6 | 6 | 8 | 8 | 8 |
| 49.5° C. to 50.4° C. | 7 | 6 | 5 | 11 | 10 | 9 | 14 | 12 | 10 |
| 50.5° C. to 51.4° C. | 14 | 12 | 10 | 22 | 20 | 18 | 28 | 24 | 20 |
| 51.5° C. to 52.4° C. | 28 | 24 | 20 | 44 | 40 | 36 | 56 | 48 | 40 |
| 52.5° C. to 53.4° C. | 56 | 48 | 40 | 88 | 80 | 72 | 112 | 96 | 80 |
| 53.5° C. to 54.4° C. | 139 | 119 | 99 | 219 | 209 | 179 | 278 | 238 | 198 |
| 54.5° C. or higher | 278 | 238 | 198 | 438 | 418 | 358 | 556 | 478 | 398 |
| Activation threshold value | 30,000 | | | | | | | | |

TABLE 6

| | 5K cartridge | | | | | |
|---|---|---|---|---|---|---|
| | Toner: 100% to 61% | | | Toner: 60% to 0% | | |
| | Coverage rate: lower than 1.5% | Coverage rate: 1.5% or more and lower than 3% | Coverage rate: 3% or more | Coverage rate: lower than 1.5% | Coverage rate: 1.5% or more and lower than 3% | Coverage rate: 3% or more |
| 47.4° C. or lower | 0 | 0 | 0 | 0 | 0 | 0 |
| 47.5° C. to 48.4° C. | 3 | 3 | 2 | 4 | 4 | 4 |
| 48.5° C. to 49.4° C. | 6 | 6 | 4 | 8 | 8 | 8 |
| 49.5° C. to 50.4° C. | 10 | 9 | 7 | 14 | 12 | 10 |
| 50.5° C. to 51.4° C. | 20 | 18 | 14 | 28 | 24 | 20 |
| 51.5° C. to 52.4° C. | 40 | 36 | 28 | 56 | 48 | 40 |
| 52.5° C. to 53.4° C. | 80 | 72 | 56 | 112 | 96 | 80 |
| 53.5° C. to 54.4° C. | 170 | 144 | 139 | 278 | 238 | 198 |
| 54.5° C. or higher | 358 | 308 | 278 | 556 | 478 | 398 |
| Activation threshold value | 30,000 | | | | | |

When the point in the initial state of the 10K cartridge and the point in the initial state of the 5K cartridge are compared with each other, the point of the 5K cartridge is larger in weighting due to the following reason. That is, as described above, the 10K cartridge and the 5K cartridge differ in rate of toner in the vicinity of the developing roller 42 with respect to the toner in the container 41 (rate is higher in the 5K cartridge than in the 10K cartridge). Therefore, the influence on the state of toner in the vicinity of the developing roller 42 is more liable to appear in the 5K cartridge than in the 10K cartridge.

For the above-mentioned reason, in both of the 10K cartridge and the 5K cartridge, the weighting is larger for the point in a case in which the toner remaining amount is small, which means that the usage history is long, as compared to the point in a case in which the toner remaining amount is large. Further, for the above-mentioned reason, the weighting is larger for the point in a case in which the coverage rate is low, which means that the consumption amount of toner to be consumed from the developing device 4 per predetermined unit is small, as compared to the point in a case in which the coverage rate is high.

Information on the point table and the threshold value as shown in Table 5 and Table 6 is obtained by performing, for example, experiments in advance, and is stored in the ROM 53 of the controller 50. Then, when the CPU 51 of the controller 50 starts duplex printing, the CPU 51 obtains the temperature information, the coverage rate information, the toner remaining amount information, and the identification information representing the type of the cartridge B. Further, the controller 50 refers to the above-mentioned table during the duplex printing to sequentially add and store (update) the point selected based on the environmental information, the coverage rate information, the toner remaining amount information, and the identification information representing the type of the cartridge B to the RAM 52 of the controller 50. The point is an example of the index value for digitizing the state of toner. Then, the controller 50 switches the mode from the normal mode to the temperature rise suppression mode when the update value of the point reaches the threshold value.

Figure 7:
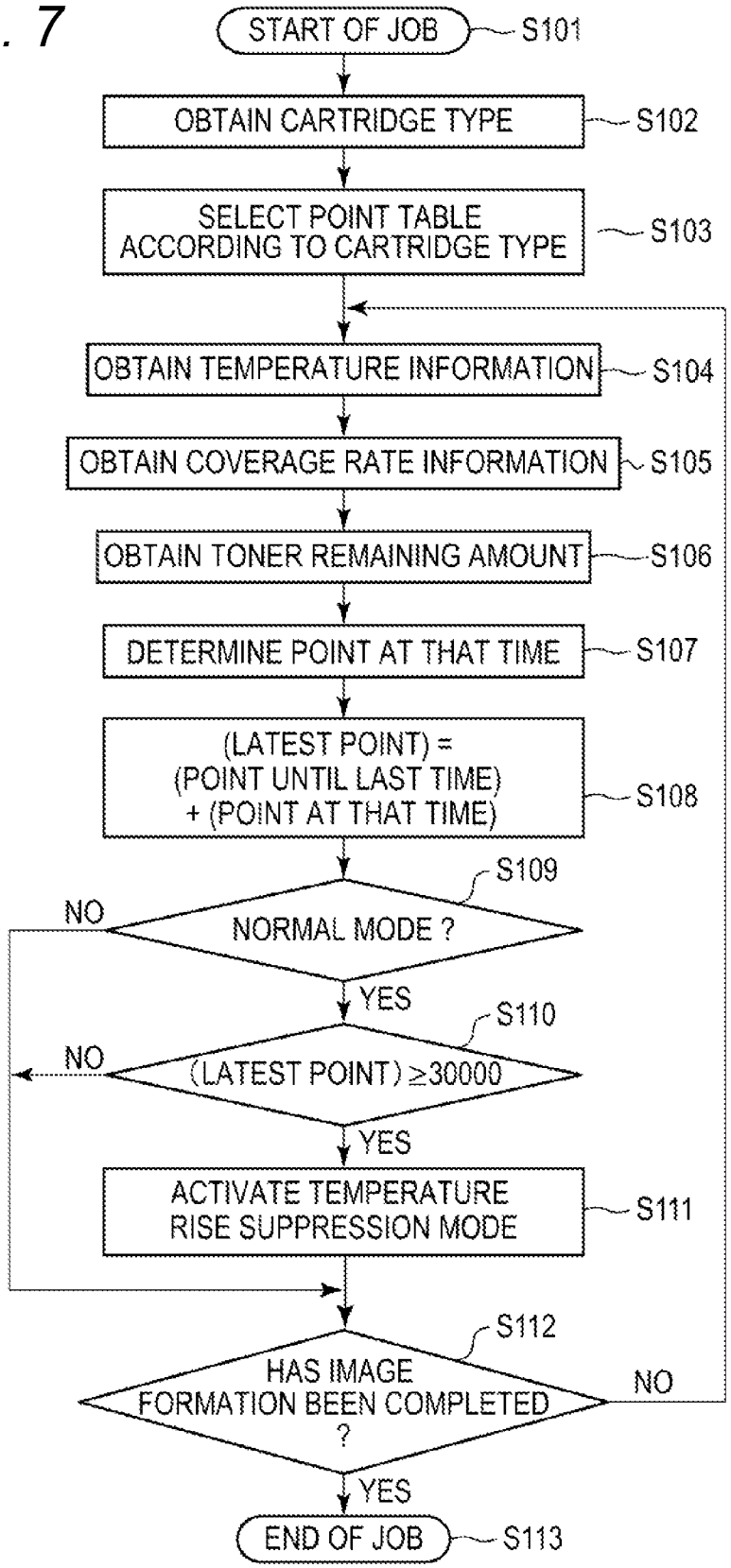
FIG. 7 is a flow chart for illustrating control of determining whether or not to allow activation of a temperature rise suppression mode.

FIG. 7 is a flow chart for schematically illustrating a procedure of control of determining whether or not to allow activation of the temperature rise suppression mode in a job (series of operations for forming an image onto a single or a plurality of recording materials P to output the image, which is started in response to one instruction) of the duplex printing in the first embodiment.

When information on the job of the duplex printing is input to the CPU 51 from the external device 200, the CPU 51 starts the job of the duplex printing based on a print start signal (Step S101). Further, the CPU 51 obtains the identification information representing the type of the cartridge B from the cartridge memory 14 (Step S102). Next, the CPU 51 selects, based on the obtained identification information, from between the point table for the 10K cartridge and the point table for the 5K cartridge stored in the ROM 53, the point table corresponding to the cartridge B mounted to the image forming apparatus 100 (Step S103). In the first embodiment, the identification information is obtained and the point table is selected before the first image formation of the job is started.

Next, the CPU 51 obtains the temperature information detected by the environment sensor 15 (Step S104). In the first embodiment, the temperature information is sequentially obtained at intervals of one second after the image formation of the job (in more detail, heating of the fixing device 10) is started. In this case, the image formation of the job of the duplex printing is started in the normal mode. Next, the CPU 51 obtains the coverage rate information obtained by the image processing portion 70 (Step S105). In the first embodiment, the image processing portion 70 obtains the coverage rate for each image to be formed on one recording material P, and the coverage rate information obtained by the CPU 51 is updated for each image. That is, in the first embodiment, the coverage rate information to be used for selection of the point together with the temperature information that is sequentially updated at intervals of one second has a constant value for one image. However, the present invention is not limited thereto, and for each predetermined section of one image, for example, in synchronization with the update of the temperature information, the coverage rate information may be obtained (updated). Next, the CPU 51 obtains the toner remaining amount information detected by the remaining amount detecting portion 30 (Step S106). In the first embodiment, the toner remaining amount information is obtained at intervals of one each second in synchronization with the obtaining of the temperature information. However, the present invention is not limited thereto, and, for example, the toner remaining amount information may be obtained (updated) each time one image is formed.

Next, the CPU 51 refers to the point table selected in Step S103 to select the value of the point at that time corresponding to the temperature information, the coverage rate information, and the toner remaining amount information obtained in Step S104 to Step S106 (Step S107). In the first embodiment, the point is selected at intervals of one second in synchronization with the obtaining of the temperature information. Next, the CPU 51 adds the value of the point at that time, which is obtained in Step S107, to the update value of the point until last time, which is stored in the RAM 52. Then, the CPU 51 stores the update value of the latest point to the RAM 52 to update the update value of the point (Step S108).

Next, the CPU 51 determines whether or not the present mode is the normal mode (Step S109). As described above, the image formation of the job of the duplex printing is started in the normal mode, and hence it is normally first determined that the present mode is the normal mode in Step S109. Next, when the CPU 51 determines that the present mode is the normal mode in Step S109, the CPU 51 determines whether or not the update value of the latest point stored in the RAM 52 reaches a threshold value (in the first embodiment, 30,000) stored in the ROM 53 (Step S110). Then, when the CPU 51 determines that the update value of the point reaches the threshold value, the CPU 51 performs switching from the normal mode to the temperature rise suppression mode (Step S111). That is, the CPU 51 inputs an instruction to the driving device 20 to perform switching from the full speed mode to the half speed mode. After that, the CPU 51 determines whether or not all of image formations of the job are completed (Step S112). When all of the image formations are completed, the CPU 51 ends the job (Step S113). When all of the image formations are not completed, the CPU 51 returns the processing to Step S104. On the other hand, when the CPU 51 determines in Step S109 that the present mode is not the normal mode, the CPU 51 maintains the temperature rise suppression mode. Further, when the CPU 51 determines in Step S110 that the update value of the point does not reach the threshold value, the CPU 51 maintains the normal mode, and advances the processing to Step S112.

In the first embodiment, every time the job is ended, the controller 50 resets the update value of the point, which is sequentially updated and stored in the RAM 52, to an initial value (in the first embodiment, 0).

As described above, in the first embodiment, the controller 50 performs the switching from the first mode (normal mode) to the second mode (temperature rise suppression mode) when the update value of the latest point reaches the threshold value stored in the ROM 53 during the continuous printing. In the first embodiment, the above-mentioned threshold value is 30,000 points. In this case, in the first embodiment, as shown in Table 5 and Table 6, when the temperature is equal to or lower than a predetermined temperature (in the first embodiment, equal to or lower than 47.4° C.), the point to be added is 0. That is, in the first embodiment, the controller 50 can perform the switching from the first mode (normal mode) to the second mode (temperature rise suppression mode) when the temperature detected by the environment sensor 15 during the continuous printing is equal to or higher than a predetermined temperature (in the first embodiment, equal to or higher than 47.5° C.). Further, in the first embodiment, a time period from the start of the continuous printing until the above-mentioned switching is performed is shorter in, as compared to a case in which an image having a predetermined first coverage rate is continuously formed in the continuous printing, a case in which an image having a predetermined second coverage rate, which is lower than the first coverage rate, is continuously formed in the continuous printing. Further, in the first embodiment, the time period from the start of the continuous printing until the above-mentioned switching is performed is shorter in, as compared to a case in which the used amount from the initial state of the developing device 4 is a first used amount, a case in which the used amount from the initial state of the developing device 4 is a second used amount, which is larger than the first used amount. Further, in the first embodiment, the time period from the start of the continuous printing until the above-mentioned switching is performed is shorter in, as compared to a case in which the toner amount in the initial state of the developing device 4 mounted to the image forming apparatus 100 is a first amount, a case in which the toner amount in the initial state of the developing device 4 mounted to the image forming apparatus 100 is a second amount, which is smaller than the first amount. In particular, in the first embodiment, the above-mentioned continuous printing is duplex continuous printing, in which images are formed on both surfaces of the recording material P.

In the first embodiment, the switching from the first mode (normal mode) to the second mode (temperature rise suppression mode) is performed based on the update value obtained by adding over time the weighted index value. However, the present invention is not limited to this mode. The above-mentioned switching may be performed based on the update value obtained by subtracting over time the weighted index value. For example, the update value is obtained by, with use of the point (in the first embodiment, 30,000 points) corresponding to the threshold value in the first embodiment as an initial value, sequentially subtracting the point that is weighted similarly to the first embodiment. Then, when the update value reaches 0 points being the threshold value in place of the threshold value in the first embodiment, the above-mentioned switching can be performed. Alternatively, with use of an initial value of 0 points, when the update value reaches a predetermined threshold value, which is a negative value, the above-mentioned switching may be performed. Specifically, in Step S108 of FIG. 7 described above, the CPU 51 adds the point of this time to the accumulated value until the last time as the update value, but instead, the CPU 51 sequentially subtracts the point of this time from the accumulated value. Further, in Step S110 of FIG. 7, the CPU 51 determines whether or not the update value is equal to or larger than the threshold value, but the CPU 51 may determine whether or not the update value obtained through subtraction is equal to or lower than the threshold value.

Further, the case in which the update value of the index value reaches the threshold value corresponds to, for example, a case in which when the index value is sequentially added, typically, the update value of the index value becomes the threshold value. However, this does not mean that the above-mentioned switching is performed immediately after the update value of the index value becomes the threshold value. For example, the above-mentioned switching may be performed after a certain period elapses due to the transition of the image forming operation or the transition of other control. That is, when the index value is sequentially added, the case in which the update value of the index value reaches the threshold value includes a case in which the update value of the index value becomes the threshold value and a case in which the update value of the index value exceeds the threshold value. Similarly, when the index value is sequentially subtracted, the case in which the update value of the index value reaches the threshold value includes a case in which the update value of the index value becomes the threshold value and a case in which the update value of the index value falls below the threshold value.

VIII. Shift from Temperature Rise Suppression Mode to Normal Mode

The occurrence of the development stripe can be suppressed by executing the temperature rise suppression mode. However, in the first embodiment, the temperature rise suppression mode is a half speed mode, in which the process speed is half of that of the normal mode, and hence the throughput is reduced. Therefore, when it can be determined that the influence on the compaction of toner due to temperature rise has been able to be reduced, it is preferred to promptly return the mode to the normal mode.

In the first embodiment, the temperature rise suppression mode is activated when a condition in which the cohesion degree of toner reaches 50 is satisfied. Further, through execution of the temperature rise suppression mode, as described above, the temperature in the vicinity of the developing device 4 is reduced down to 45° C. It has been found that, even when there is a possibility that the cohesion degree of toner has been increased to about 50, when the temperature is decreased and the toner is mixed by stirring or other methods, the cohesion degree of toner is gradually reduced. This is because the toner coated on the developing roller 42 under a state in which there is a possibility that the cohesion degree of toner may have been increased to about 50 due to the temperature rise is consumed by printing. Further, the cohesion degree of toner to be newly supplied to the developing roller 42 under a state in which the temperature is decreased is not so high, and hence the toner that has been in the vicinity of the developing roller 42 and the newly supplied toner are mixed with each other so that the cohesion degree of toner in the vicinity of the developing roller 42 is reduced.

Figure 8:
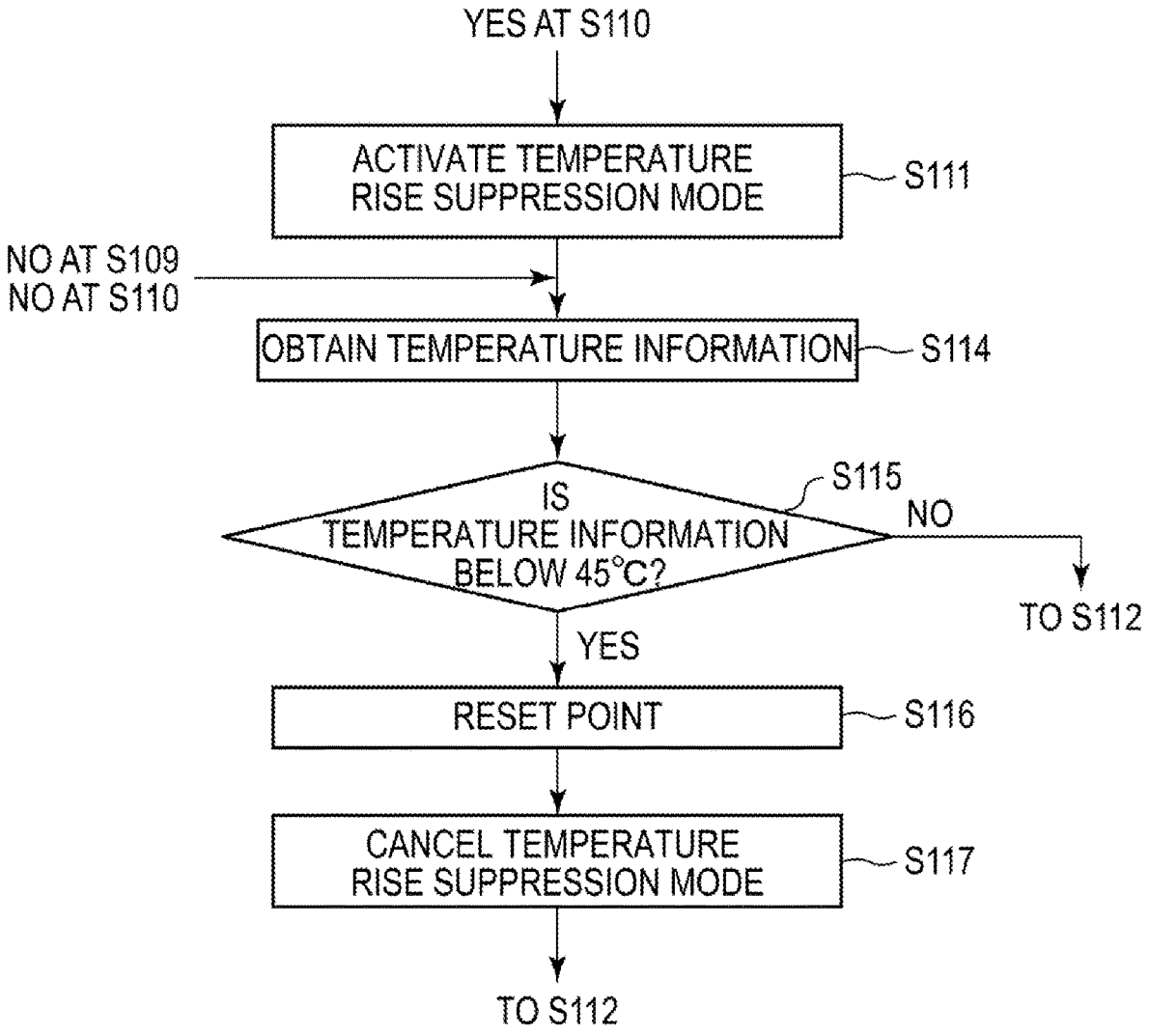
FIG. 8 is a flow chart for illustrating control of determining whether or not to allow canceling of the temperature rise suppression mode.

FIG. 8 is a flow chart for schematically illustrating a procedure of control of determining whether or not to allow canceling of the temperature rise suppression mode in a job of duplex printing in the first embodiment. Although omitted in FIG. 7, the processing illustrated in FIG. 8 can be executed between the processing of Step S111 and the processing of Step S112 of FIG. 7.

After the CPU 51 switches the mode to the temperature rise suppression mode in Step S111, the CPU 51 obtains the temperature information detected by the environment sensor 15 (Step S114). Next, the CPU 51 determines whether or not the temperature represented by the temperature information obtained in Step S114 is below 45° C. (Step S115). Then, when the CPU 51 determines that the temperature is below 45° C., the CPU 51 resets the update value of the point that has been sequentially updated and stored in the RAM 52 to the initial value (in the first embodiment, 0) (Step S116). Then, the CPU 51 performs switching from the temperature rise suppression mode to the normal mode (Step S117). That is, the CPU 51 inputs an instruction to the driving device 20 to perform switching from the half speed mode to the full speed mode. After that, the CPU 51 advances the processing to Step S112 of FIG. 7. On the other hand, when the CPU 51 determines that the temperature is not below 45° C. in Step S115, the CPU 51 maintains the temperature rise suppression mode and advances the processing to Step S112 of FIG. 7.

In this case, when the temperature detected by the environment sensor 15 is below 45° C., the update value of the point until the last time is reset due to the following reason. That is, in the configuration of the first embodiment, the compaction of toner occurs when the cohesion degree of toner exceeds 55, and the compaction may become an irreversible change in which the toner cannot return to the original state even when the temperature is decreased thereafter. In contrast, when the cohesion degree of toner is only 50 or lower, the development stripe does not occur, and the cohesion degree of toner is decreased as the temperature is decreased.

IX. Effect of First Embodiment

Next, results of an experiment performed to investigate the effect of the first embodiment are described. In this case, under the following conditions, the number of print images, a time period required until printing of all of the images is completed, and whether or not the development stripe has occurred were investigated in each of the full speed mode (normal mode) and the half speed mode (temperature rise suppression mode) in a case in which the duplex continuous printing was performed. Evaluation criteria of the development stripe were represented by, similarly to the case of Table 1, "○" (no occurrence of development stripe or disturbance of toner coating), "Δ" (only disturbance of toner coating occurred, and no occurrence of development stripe), and "x" (development stripe occurred).

(1) Comparison Between Comparative Examples and First Embodiment

The first embodiment and Comparative Examples were compared with each other. In Comparative Examples, when the temperature detected by the environment sensor 15 reached the predetermined threshold value, the mode was promptly switched from the full speed mode (normal mode) to the half speed mode (temperature rise suppression mode). In this case, a temperature of 48° C., at which the influence of compaction of toner started to appear, was set as the threshold value of the temperature in Comparative Example 1. Further, in the case of Comparative Example 2, a temperature of 52° C., which was higher than that in the case of Comparative Example 1, was set as the threshold value. Except for the above-mentioned points, the first embodiment and Comparative Examples had substantially the same configuration and operation. The conditions of the experiment are as follows. Further, the results are shown in Table 7.

<Conditions>

Environment: 32° C. and 80% RH
Cartridge type: 10K cartridge
Toner remaining amount: 50%
Coverage rate: 1.5%
Print images: 1,200 images
Printing operation setting: duplex continuous

TABLE 7

| Configuration | Full speed/ Half speed Number of print images | Required time period | Development stripe |
|---|---|---|---|
| First Embodiment | 1,160/40 | 62 min. | ○ (No occurrence) |
| Comparative Example 1 | 380/820 | 101 min. | ○ (No occurrence) |
| Comparative Example 2 | 1,200/0 | 60 min. | Δ (Coating disturbance at time of 1,200 sheets) |

In Comparative Example 1, when the temperature detected by the environment sensor 15 reaches 48° C., the mode is promptly switched from the full speed mode to the half speed mode. Therefore, in Comparative Example 1, only 380 images among the 1,200 images were able to be printed in the full speed mode, and the time period required to print the 1,200 images was 101 minutes. This was because the threshold value was set to a relatively low temperature of 48° C. with a margin. Further, in Comparative Example 2, the temperature did not reach 52° C. after all. Therefore, the 1,200 images were able to be printed at full speed, and no development stripe occurred. However, in Comparative Example 2, when the toner coating was observed after printing of the 1,200 images was completed, coating disturbance was observed. When the printing was thereafter further continued, a development stripe actually occurred after 1,250 images were printed.

In contrast, in the first embodiment, 1,160 images among the 1,200 images were able to be printed at full speed, and the time period required to print the 1,200 images was 62 minutes. That is, in the first embodiment, while occurrence of the development stripe was suppressed, printing was able to be performed in the full speed mode even under a state in which the temperature was higher than 48° C., which was the threshold value of the temperature in Comparative Example 1. In this manner, in the first embodiment, while an image defect to be caused by compaction of toner, for example, a development stripe, is suppressed, the throughput can be improved as compared to a configuration in which the temperature rise suppression mode is activated when the temperature simply reaches the threshold value as in Comparative Example 1. In the first embodiment, printing was continued further after the 1,200 images until 1,500 images, but it was confirmed that no development stripe occurred and no problem of coating disturbance occurred.

(2) Comparison Between Cases in which Coverage Rates Are Different

Comparison between cases in which the coverage rates of the images to be formed were different (1.5% and 3%) was performed in the configuration of the first embodiment. When the coverage rate is high, a larger amount of toner coated on the developing roller 42 is exchanged, and hence the same toner is less liable to continuously stay on the surface of the developing roller 42. Therefore, the cohesion degree of toner is less liable to increase. Conditions of the experiment are as follows. Further, the results are shown in Table 8.

<Conditions>

Environment: 32° C. and 80% RH
Cartridge type: 10K cartridge
Toner remaining amount: 50%
Coverage rates: 1.5% and 3%
Print images: 1,200 images
Printing operation setting: duplex continuous

TABLE 8

| Coverage rate | Full speed/ Half speed Number of print images | Required time period | Development stripe |
|---|---|---|---|
| 1.5% | 1,160/40 | 62 min. | ○ (No occurrence) |
| 3% | 1,200/0 | 60 min. | ○ (No occurrence) |

When the coverage rate is 3%, a development stripe does not occur even when all of the images are printed in the full speed mode, and the time period required to print the images can be decreased. That is, according to the first embodiment, when the state of toner is estimated in consideration of the coverage rate information, the condition for activating the temperature rise suppression mode can be relaxed (60 minutes) in a case in which an image having a high coverage rate is formed. As a result, the throughput can be improved.

(3) Comparison Between Cases in which Usage Histories Are Different

Comparison between cases in which the usage histories of the cartridge B (developing device 4) were different (toner remaining amounts of 100%, 60%, and 30%) was performed in the configuration of the first embodiment. When the usage history is long, causes of toner change, such as wax seepage and reduction in toner flowability, are increased. The usage history can be determined with use of the toner remaining amount. In this case, in the initial state, in which the toner remaining amount is sufficiently large, the rate of the toner that occupies in the vicinity of the developing roller 42 with respect to the toner in the container 41 is lower in the cartridge B having a long setting life than in the cartridge B having a short setting life, and hence the cartridge B having a long setting life is insusceptible to the state of toner in the vicinity of the developing roller 42. However, when the toner remaining amount is decreased, the change in toner remaining amount is larger in the cartridge B having a long setting life than in the cartridge B having a short setting life, and accordingly the cartridge B having a long setting life is greatly susceptible to the usage history. Therefore, the cartridge B having a long setting life becomes susceptible to the state of toner in the vicinity of the developing roller 42. Therefore, in this case, with use of the 10K cartridge being greatly susceptible to the usage history, the influence caused by the difference in toner remaining amount (usage history) was investigated. Conditions of the experiment are as follows. Further, the results are shown in Table 9.

<Conditions>

Environment: 32° C. and 80% RH
Cartridge type: 10K cartridge
Toner remaining amounts: 100%, 60%, and 30%
Print images: 1,200 images
Coverage rate: 1.5%
Printing operation setting: duplex continuous

TABLE 9

| Cartridge/Toner remaining amount | Full speed/ Half speed Number of print images | Required time period | Development stripe |
|---|---|---|---|
| 10K/100% | 1,200/0 | 60 min. | ○ (No occurrence) |
| 10K/60% | 1,160/40 | 62 min. | ○ (No occurrence) |
| 10K/30% | 1,060/140 | 67 min. | ○ (No occurrence) |

As the usage history is increased, the number of images that can be printed in the full speed mode is decreased, and hence the time period required to print the images is increased. However, the occurrence of the development stripe was not observed in any of the cases, and satisfactory results were obtained.

In this case, there are shown in Table 10 the results of a case in which, in order to improve the throughput as compared to that in the first embodiment, a table having a point corresponding to a case in which the toner remaining amount is larger than the original toner remaining amount is used. In Table 10, for comparison, the results of the first embodiment shown in Table 9 are also shown.

TABLE 10

| Cartridge/Toner remaining amount | Full speed/ Half speed Number of print images | Required time period | Development stripe |
|---|---|---|---|
| 10K/60% | 1,200/0 | 60 min. | Δ (Occurred from 1,180 sheets) |
| 10K/60% (Embodiment) | 1,160/40 | 62 min. | ○ (No occurrence) |
| 10K/30% | 1,160/40 | 62 min. | Δ (Occurred from 1,080 sheets) |
| 10K/30% (Embodiment) | 1,060/140 | 67 min. | ○ (No occurrence) |

As shown in Table 10, when a table that allowed reduction of the time period required to print the images as compared to that in the first embodiment was used, although the level was very low, the disturbance of the toner coating on the developing roller 42 occurred. In contrast, in the first embodiment, although the time period required to print the images is slightly increased, a development stripe or disturbance of the toner coating on the developing roller 42 does not occur.

As described above, according to the first embodiment, when a table having a point corresponding to the toner remaining amount (usage history) is set in advance for each type of cartridge B, the state of toner can be estimated in consideration of the toner remaining amount (usage history). In this manner, while the reduction in throughput is suppressed, occurrence of an image defect, for example, a development stripe, can be suppressed.

(4) Comparison between Cases in which Setting Lives are Different

Comparison between cases in which setting lives of the cartridge B (developing device 4) were different (10K and 5K) was performed in the configuration of the first embodiment. As described above, when the setting life of the cartridge B is different, in many cases, the shape of the container 41 is changed (FIG. 5A and FIG. 5C). Conditions of the experiment are as follows. Further, the results are shown in Table 11.

<Conditions>

Environment: 32° C. and 80% RH
Cartridge types: 10K cartridge and 5K cartridge
Toner remaining amount: 100%
Print images: 1,200 images and 1,500 images
Coverage rate: 1.5%
Printing operation setting: duplex continuous

TABLE 11

| Cartridge/Toner remaining amount | Full speed/ Half speed Number of print images | Required time period | Development stripe |
|---|---|---|---|
| 10K/100% | 1,200/0 | 60 min. | ○ (No occurrence) |
| 10K/100% | 1,380/120 | 81 min. | ○ (No occurrence) |
| 5K/100% | 1,200/0 | 60 min. | ○ (No occurrence) |
| 5K/100% | 1,200/300 | 90 min. | ○ (No occurrence) |

When 1,200 images are printed, in both of the cases using the 10K cartridge and the 5K cartridge, the printing is completed without switching the mode from the normal mode to the half speed mode. On the other hand, when 1,500 images are printed, the mode is switched from the normal mode to the half speed mode earlier in the case using the 5K cartridge than in the case using the 10K cartridge.

There are now shown in Table 12 the results of a case in which 1,500 images are printed with use of a table having the same point as that for the 10K cartridge when the 5K cartridge is used. In Table 12, for comparison, the results of a case in which 1,500 images are printed with use of the table having the point for the 10K cartridge when the 10K cartridge is used are also shown.

TABLE 12

| Cartridge/Toner remaining amount | Full speed/ Half speed Number of print images | Required time period | Development stripe |
|---|---|---|---|
| 10K/100% | 1,380/120 | 81 min. | ○ (No occurrence) |
| 5K/100% | 1,200/300 | 90 min. | ○ (No occurrence) |
| 5K/100% | 1,380/120 | 81 min. | Δ (Occurred from 1,280 sheets) |

As shown in Table 12, when printing was performed with use of the table having the same point as that for the 10K cartridge when the 5K cartridge was used, although the level was very low, disturbance of the toner coating on the developing roller 42 occurred.

As described above, according to the first embodiment, for example, when a table having a point that is different from that for the 10K cartridge is set for the 5K cartridge, the occurrence of the development stripe can be suppressed in accordance with the shape of the container 41 (toner amount in the initial state).

As described above, according to the first embodiment, even when the low-temperature fixing toner is used, while occurrence of the image defect is suppressed, the number of sheets that can be printed until the temperature rise suppression mode is activated can be increased. Therefore, according to the first embodiment, while an image defect to be caused by temperature rise in the image forming apparatus 100 is suppressed, reduction in throughput can be suppressed.

The low-temperature fixing toner can be produced by, for example, suspension polymerization by mixing, in a binder resin, a styrene acrylic resin, a magnetic material, a crystalline polyester, and an ester wax as main components. Further, as a mixing ratio, for example, in the binder resin, 90 parts of styrene acrylic resin, 90 parts of magnetic material, 10 parts of crystalline polyester, and 10 parts of ester wax may be mixed as a suitable example. Further, as suitable conditions, there may be given a melting point of the crystalline polyester of 74° C. and a glass transition temperature of toner (binder resin) of from 50° C. to 60° C.

Second Embodiment

Next, another embodiment will be described. Basic configuration and operation of an image forming apparatus according to a second embodiment are the same as those of the first embodiment. Therefore, elements of the image forming apparatus according to the second embodiment that have the same or corresponding functions or configurations as those of the image forming apparatus according to the first embodiment are denoted by the same reference symbols as those of the first embodiment, and detailed description thereof is omitted herein.

In the first embodiment, the threshold value for determining whether or not to allow activation of the temperature rise suppression mode is a fixed value, and the point to be sequentially added is changed in accordance with various causes. In this manner, the state of toner can be estimated more finely.

In contrast, for example, as for a part of the causes, for example, the toner remaining amount (usage history), instead of changing the weighting of the point in accordance with the cause, the threshold value may be changed in accordance therewith.

Table 13 is an example (for the 10K cartridge) of a threshold value and a table having a point in a case in which the threshold value is changed in accordance with the toner remaining amount in the second embodiment.

TABLE 13

| | 10K cartridge Toner: 100% to 0% | | |
|---|---|---|---|
| | Coverage rate: lower than 1.5% | Coverage rate: 1.5% or more and lower than 3% | Coverage rate: 3% or more |
| 47.4° C. or lower | 0 | 0 | 0 |
| 47.5° C. to 48.4° C. | 2 | 2 | 2 |
| 48.5° C. to 49.4° C. | 4 | 4 | 4 |
| 49.5° C. to 50.4° C. | 7 | 6 | 5 |
| 50.5° C. to 51.4° C. | 14 | 12 | 10 |
| 51.5° C. to 52.4° C. | 28 | 24 | 20 |
| 52.5° C. to 53.4° C. | 56 | 48 | 40 |
| 53.5° C. to 54.4° C. | 139 | 119 | 99 |
| 54.5° C. or higher | 278 | 238 | 198 |
| Toner: 100% to 61% Activation threshold value | | 30,000 | |
| Toner: 60% to 31% Activation threshold value | | 20,000 | |
| Toner: 30% to 0% Activation threshold value | | 15,000 | |

As described above, in the second embodiment, the controller 50 changes the threshold value for determining whether or not to allow activation of the temperature rise suppression mode in accordance with the used amount information related to the used amount from the initial state of the developing device 4. At this time, when the controller 50 adds the index value over time, the controller 50 can change the above-mentioned threshold value so that, as compared to the case in which the used amount represented by the used amount information is the first used amount, the case in which the used amount represented by the used amount information is the second used amount, which is larger than the first used amount, takes a smaller value. Further, when the controller 50 subtracts the index value over time, the controller 50 can change the above-mentioned threshold value so that, as compared to the case in which the used amount represented by the used amount information is the first used amount, the case in which the used amount represented by the used amount information is the second used amount, which is larger than the first used amount, takes a larger value.

According to the second embodiment, the estimation accuracy of the state of toner related to the toner remaining amount is slightly reduced as compared to that in the first embodiment, but the point table becomes relatively simpler, and the control can be simplified.

[Others]

The present invention has been described by way of specific embodiments, but the present invention is not limited to the above-mentioned embodiments.

In the above-mentioned embodiments, as causes other than temperature and time, the coverage rate, the usage history, and the type (setting life) of the cartridge B are all considered when the state of toner is estimated. However, depending on the desired estimation accuracy or the like, as causes other than temperature and time, only a part of the coverage rate, the usage history, and the type (setting life) of the cartridge B may be considered when the state of toner is estimated.

Further, in the above-mentioned embodiments, as the temperature rise suppression mode for suppressing the temperature rise in the image forming apparatus, there is one type of mode, specifically, the half speed mode. The temperature rise suppression mode is not limited to a mode for setting the process speed to half of that in the normal mode, and a predetermined process speed that is lower than that in the normal mode can be set depending on a desired temperature rise suppression effect or the like. Further, as the temperature rise suppression mode, a mode having a plurality of different process speeds that are lower than that in the normal mode may be provided. Further, a plurality of threshold values can be set with respect to the update value obtained by adding or subtracting the value weighted based on the history of temperature or the like. Further, the process speed in the temperature rise suppression mode can be changed in stages. For example, the process speed can be decreased as the above-mentioned update value is increased in a case in which the index value is added. Further, in the temperature rise suppression mode, in addition to or instead of changing the process speed, the printing operation may be suspended (sheet interval may be extended). The suspension time can be set as appropriate in accordance with the desired temperature rise suppression effect or the like.

Further, in the above-mentioned embodiments, the index value (point) that has been weighted in accordance with various causes and set in advance as table data is sequentially selected to be added or subtracted. In this manner, the weighted index value is sequentially added or subtracted so that the update value is obtained. However, the present invention is not limited to this mode. For example, a weight coefficient that is set in advance in accordance with various causes may be used, and the index value sequentially obtained through calculation may be added or subtracted so that the update value is obtained.

Further, the toner used in the above-mentioned embodiments has sensitivity with respect to temperature, but the sensitivity with respect to humidity is small to an ignorable extent. Therefore, in the above-mentioned embodiments, the state of toner is estimated based on the update value obtained by adding or subtracting a value weighted in accordance with the history of temperature as the environmental information. However, the present invention is not limited thereto. For example, when a water-absorbing external additive is used, the toner may have sensitivity with respect to humidity. As an image defect to be caused by change in humidity, in addition to the development stripe to be caused by compaction of toner, which has been described in the above-mentioned embodiments, for example, reduction in image density due to variations in toner chargeability is conceivable. Therefore, similarly to the case of the temperature in the above-mentioned embodiments, the state of toner can be estimated based on the update value obtained by adding or subtracting a value weighted in accordance with the history of humidity. Typically, in order to suppress occurrence of a development stripe due to toner compaction caused by the rise of humidity, as the humidity is increased, the index value corresponding to the point in the above-mentioned embodiments is weighted to take a larger value. That is, in this case, the control unit weights the index value so that, as compared to a case in which the humidity represented by the environmental information is a first humidity, a case in which the humidity represented by the environmental information is a second humidity, which is higher than the first humidity, takes a larger value. In addition, the state of toner may be estimated based on an update value obtained by adding or subtracting a value weighted in accordance with a history combining both of temperature and humidity.

Further, in the above-mentioned embodiments, the developing device can be mounted to the apparatus main body of the image forming apparatus as the process cartridge, but the developing device (developing cartridge) alone may be able to be mounted to the apparatus main body of the image forming apparatus.

According to the embodiments, while the image defect to be caused by temperature rise in the image forming apparatus is suppressed, the reduction in throughput can be suppressed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-206161, filed Oct. 31, 2018, which is hereby incorporated by reference herein in its entirety.

What is claimed is:

1. An image forming apparatus comprising:

an image bearing member;

a latent image forming portion configured to form a latent image on the image bearing member;

a developing device including a container configured to store toner and a developing member configured to supply the toner to the latent image formed on the image bearing member to form a toner image;

an environment sensor configured to detect environmental information related to an environment in which the developing device is placed; and a controller configured to control switching between a first mode, in which a number of prints per unit time is a first number, and a second mode, in which the number of prints per unit time is a second number, which is less than the first number, wherein the controller is configured to perform switching from the first mode to the second mode based on an update value obtained by performing over time one of addition and subtraction of an index value weighted in accordance with the environmental information detected by the environment sensor.

2. The image forming apparatus according to claim 1, wherein the controller is configured to perform the switching from the first mode to the second mode when the update value reaches a predetermined threshold value.

3. The image forming apparatus according to claim 1, wherein the controller is configured to weight the index value so that the index value in a case in which a temperature represented by the environmental information is a second temperature is greater than the index value in a case in which the temperature represented by the environmental information is a first temperature, the second temperature being higher than the first temperature.

4. The image forming apparatus according to claim 1, wherein the controller is configured to weight the index value so that the index value in a case in which a humidity represented by the environmental information is a second humidity is greater than the index value in a case in which the humidity represented by the environmental information is a first humidity, the second humidity being higher than the first humidity.

5. The image forming apparatus according to claim 1, wherein the controller is configured to perform the switching from the first mode to the second mode based on the update value obtained by performing over time the one of addition and subtraction of the index value weighted in accordance with at least one piece of other information in addition to the environmental information.

6. The image forming apparatus according to claim 5, wherein the at least one piece of other information includes toner consumption amount information related to a consumption amount of the toner to be consumed from the developing device per predetermined unit in an image forming operation.

7. The image forming apparatus according to claim 6, wherein the controller is configured to weight the index value so that the index value in a case in which the consumption amount of the toner, which is represented by the toner consumption amount information, is a second consumption amount is greater than the index value in a case in which the consumption amount of the toner, which is represented by the toner consumption amount information, is a first consumption amount, the second consumption amount being less than the first consumption amount.

8. The image forming apparatus according to claim 6, wherein the toner consumption amount information is coverage rate information related to a coverage rate of an image to be formed.

9. The image forming apparatus according to claim 5, wherein the image forming apparatus is configured to mount a plurality of types of developing devices that differ in amount of the toner to be stored in the container in an initial state, and wherein the at least one piece of other information includes identification information representing a type of the developing device.

10. The image forming apparatus according to claim 9, wherein the controller is configured to weight the index value so that the index value in a case in which an amount of the toner in the initial state of the developing device mounted to the image forming apparatus, which is represented by the identification information, is a second amount is greater than the index value in a case in which the amount of the toner in the initial state of the developing device mounted to the image forming apparatus, which is represented by the identification information, is a first amount, the second amount being less than the first amount.

11. The image forming apparatus according to claim 5, wherein the at least one piece of other information includes used amount information related to a used amount from an initial state of the developing device.

12. The image forming apparatus according to claim 11, wherein the controller is configured to weight the index value so that the index value in a case in which the used amount represented by the used amount information is a second used amount is greater than the index value in a case in which the used amount represented by the used amount information is a first used amount, the second used amount being greater than the first used amount.

13. The image forming apparatus according to claim 11, wherein the used amount information is toner remaining amount information related to an amount of the toner remaining in the container.

14. The image forming apparatus according to claim 1, wherein the controller is configured to perform the switching from the first mode to the second mode when the update value reaches a predetermined threshold value, and wherein the controller is configured to change the predetermined threshold value in accordance with used amount information related to a used amount from an initial state of the developing device.

15. The image forming apparatus according to claim 14, wherein, when the controller adds the index value over time, the controller changes the predetermined threshold value so that the predetermined threshold value in a case in which the used amount represented by the used amount information is a second used amount is less than the predetermined threshold value in a case in which the used amount represented by the used amount information is a first used amount, the second used amount being greater than the first used amount, and wherein, when the controller subtracts the index value over time, the controller changes the predetermined threshold value so that the predetermined threshold value in the case in which the used amount represented by the used amount information is the second used amount is greater than the predetermined threshold value in the case in which the used amount represented by the used amount information is the first used amount.

16. An image forming apparatus comprising:

an image bearing member;

a latent image forming portion configured to form a latent image on the image bearing member;

a developing device including a container configured to store toner and a developing member configured to supply the toner to the latent image formed on the image bearing member to form a toner image;

a temperature sensor configured to detect a temperature of an environment in which the developing device is placed; and a controller configured to perform, during continuous printing in which images are continuously formed on a plurality of recording materials, switching from a first mode, in which a number of prints per unit time is a first number, to a second mode, in which the number of prints per unit time is a second number, which is less than the first number, wherein the controller is configured to perform the switching when the temperature detected by the temperature sensor during the continuous printing is equal to or higher than a predetermined temperature, and wherein a time period from start of the continuous printing until the switching is performed is shorter in a case in which an image having a second predetermined coverage rate is continuously formed in the continuous printing than in a case in which an image having a first predetermined coverage rate is continuously formed in the continuous printing, the second predetermined coverage rate being lower than the first predetermined coverage rate.

17. The image forming apparatus according to claim 16, wherein the continuous printing is duplex continuous printing, in which images are formed on both surfaces of each of the plurality of recording materials.

18. An image forming apparatus comprising:

an image bearing member;

a latent image forming portion configured to form a latent image on the image bearing member;

a developing device including a container configured to store toner and a developing member configured to supply the toner to the latent image formed on the image bearing member to form a toner image;

a temperature sensor configured to detect a temperature of an environment in which the developing device is placed; and a controller configured to perform, during continuous printing in which images are continuously formed on a plurality of recording materials, switching from a first mode, in which a number of prints per unit time is a first number, to a second mode, in which the number of prints per unit time is a second number, which is less than the first number, wherein the image forming apparatus is configured to allow a plurality of types of developing devices to be mounted thereto, the plurality of types of developing devices differing in amount of the toner to be stored in the container in an initial state, wherein the controller is configured to perform the switching when the temperature detected by the temperature sensor during the continuous printing is equal to or higher than a predetermined temperature, and wherein a time period from start of the continuous printing until the switching is performed is shorter in a case in which the amount of the toner in the initial state of the developing device mounted to the image forming apparatus is a second amount than in a case in which the amount of the toner in the initial state of the developing device mounted to the image forming apparatus is a first amount, the second amount being smaller than the first amount.

* * * * *